US008392179B2

(12) United States Patent
Yu et al.

(10) Patent No.: US 8,392,179 B2
(45) Date of Patent: Mar. 5, 2013

(54) MULTIMODE CODING OF SPEECH-LIKE AND NON-SPEECH-LIKE SIGNALS

(75) Inventors: Rongshan Yu, Singapore (SG); Regunathan Radhakrishnan, San Bruno, CA (US); Robert Andersen, San Francisco, CA (US); Grant Davidson, Burlingame, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 301 days.

(21) Appl. No.: 12/921,752

(22) PCT Filed: Mar. 12, 2009

(86) PCT No.: PCT/US2009/036885

§ 371 (c)(1),
(2), (4) Date: Sep. 9, 2010

(87) PCT Pub. No.: WO2009/114656

PCT Pub. Date: Sep. 17, 2009

(65) Prior Publication Data

US 2011/0010168 A1 Jan. 13, 2011

Related U.S. Application Data

(60) Provisional application No. 61/069,449, filed on Mar. 14, 2008.

(51) Int. Cl.
*G10L 11/06* (2006.01)

(52) U.S. Cl. ..... 704/214; 704/200; 704/208; 704/219

(58) Field of Classification Search ..... 704/200–204, 704/214, 219, 500–504
See application file for complete search history.

(56) References Cited

U.S. PATENT DOCUMENTS

| | | | | |
|---|---|---|---|---|
| 5,778,335 | A * | 7/1998 | Ubale et al. | 704/219 |
| 5,819,212 | A * | 10/1998 | Matsumoto et al. | 704/219 |
| 6,298,322 | B1 * | 10/2001 | Lindemann | 704/222 |
| 6,658,383 | B2 * | 12/2003 | Koishida et al. | 704/229 |
| 6,785,645 | B2 * | 8/2004 | Khalil et al. | 704/216 |
| 6,961,698 | B1 * | 11/2005 | Gao et al. | 704/229 |
| 7,146,311 | B1 | 12/2006 | Uvliden | |

(Continued)

FOREIGN PATENT DOCUMENTS

| | | |
|---|---|---|
| EP | 0714089 | 5/1996 |
| WO | 9965017 | 12/1999 |

OTHER PUBLICATIONS

Yong, et al,"Encoding of LPC Spectral Parameters Using Switched-Adaptive Interframe Vector Prediction", Department of Electrical and Computer Engineering, University of California, Santa Barbara, CA 93106, 1988 IEEE, p. 402-405.

(Continued)

*Primary Examiner* — Douglas Godbold

(57) ABSTRACT

The invention relates to the coding of audio signals that may include both speech-like and non-speech-like signal components. It describes methods and apparatus for code excited linear prediction (CELP) audio encoding and decoding that employ linear predictive coding (LPC) synthesis filters controlled by LPC parameters, a plurality of codebooks each having codevectors, at least one codebook providing an excitation more appropriate for non-speech-like signals and at least one codebook providing an excitation more appropriate for speech-like signals, and a plurality of gain factors, each associated with a codebook. The encoding methods and apparatus select from the codebooks codevectors and/or associated gain factors by minimizing a measure of the difference between the audio signal and a reconstruction of the audio signal derived from the codebook excitations. The decoding methods and apparatus generate a reconstructed output signal from the LPC parameters, codevectors, and gain factors.

26 Claims, 11 Drawing Sheets

U.S. PATENT DOCUMENTS

| | | | | |
|---|---|---|---|---|
| 7,194,408 | B2 | 3/2007 | Uvliden | |
| 7,203,638 | B2 * | 4/2007 | Jelinek et al. | 704/201 |
| 7,590,527 | B2 * | 9/2009 | Yasunaga et al. | 704/223 |
| 2002/0035470 | A1 | 3/2002 | Gao | |
| 2007/0118379 | A1 | 5/2007 | Yamaura | |
| 2008/0040105 | A1 | 2/2008 | Wang | |
| 2008/0147414 | A1 * | 6/2008 | Son et al. | 704/500 |
| 2008/0162121 | A1 * | 7/2008 | Son et al. | 704/201 |

OTHER PUBLICATIONS

Jian Zhang et al: "Implementation of a low delay modified CELP coder at 4.8 kb/s", Global Telecommunications Conference,1995. Conference Record. Communi Cation Theory Mini-Conference, GLOBECOM'95., IEEE Singapore Nov. 13-17, 1995, New York, NY, USA,IEEE, US, vol. 3, Nov. 13, 1995, pp. 1610-1614.

Cuperman V et al: Spectral excitation coding of speech at 2.4 kb/sW 19950509; 19950509-19950512, vol. 1, May 9, 1995, pp. 496-499.

Jian Zhang et al: "A 4.2 kb/s Low-Del ay Speech Coder with Modified CELP" IEEE Signal Processing Letters, IEEE Service Center, Piscataway, NJ, US, vol. 4, No. 11, Nov. 1, 1997.

J.-H. Chen and D. Proc. Wang, "Transform Predictive Coding of Wideband Speech Signals," Proc ICASSP-96, vol. 1, May 1996.

S. Wang, "Phonetic Segmentation Techniques for Speech Coding," Ph.D. Thesis, University of California, Santa Barbara, 1991.

A. Das, E. Paksoy, A. Gersho, "Multimode and Variable-Rate Coding of Speech," in Speech Coding and Synthesis, W. B. Kleijn and K.K. Paliwal Eds., Elsevier Science B.V., 1995.

B. Bessette, R. Lefebvre, R. Salami, "Universal Speech/Audio Coding using Hybrid ACELP/TCX Techniques," Proc. ICASSP-2005, Mar. 2005.

S. Ramprashad, "A Multimode Transform Predictive Coder (MTPC) for Speech and Audio," IEEE Speech Coding Workshop, Helsinki, Finland, Jun. 1999.

S. Ramprashad, "The Multimode Transform Predictive Coding Paradigm," IEEE Trans. on Speech and Audio Processing, Mar. 2003.

Shoji Makino (Editor), Te-Won Lee (Editor), Hiroshi Sawada (Editor), Blind Speech Separation (Signals and Communication Technology), Springer, 2007.

A. M. Kondoz, Digital speech coding for low bit rate communication system, 2nd edition, section 7.3.4, Wiley, 2004.

* cited by examiner

MULTIMODE CODING OF SPEECH-LIKE AND NON-SPEECH-LIKE SIGNALS

CROSS-REFERENCE TO RELATED APPLICATIONS

This application claims priority to U.S. Patent Provisional Application No. 61/069,449, filed 14 Mar. 2008, which is hereby incorporated by reference in its entirety.

BACKGROUND OF THE INVENTION

1. Field of the Invention

The present invention relates to methods and apparatus for encoding and decoding audio signals, particularly audio signals that may include both speech-like and non-speech-like signal components simultaneously and/or sequentially in time. Audio encoders and decoders capable of varying their encoding and decoding characteristics in response to changes in speech-like and non-speech-like signal content are often referred to in the art as "multimode" "codecs" (where a "codec" may be an encoder and a decoder). The invention also relates to computer programs on a storage medium for implementing such methods for encoding and decoding audio signals.

2. Summary of the Invention

Throughout this document, a "speech-like signal" means a signal that comprises either a) a single, strong periodical component (a "voiced" speech-like signal), b) random noise with no periodicity (an "unvoiced" speech-like signal), or c) the transition between such signal types. Examples of a speech-like signal include speech from a single speaker and the music produced by certain single musical instruments;

and, a "non-speech-like signal means a signal that does not have the characteristics of a speech-like signal. Examples of a non-speech-like signal include a music signal from multiple instruments and mixed speech from (human) speakers of different pitches.

According to a first aspect of the present invention, a method for code excited linear prediction (CELP) audio encoding employs an LPC synthesis filter controlled by LPC parameters, a plurality of codebooks each having codevectors, at least one codebook providing an excitation more appropriate for speech-like signals than for non-speech-like signals and at least one other codebook providing an excitation more appropriate for non-speech-like signals than for speech like signals, and a plurality of gain factors, each associated with a codebook. The method comprises applying linear predictive coding (LPC) analysis to an audio signal to produce LPC parameters, selecting, from at least two codebooks, codevectors and/or associated gain factors by minimizing a measure of the difference between the audio signal and a reconstruction of the audio signal derived from the codebook excitations, the codebooks including a codebook providing an excitation more appropriate for a non-speech like signal and a codebook providing an excitation more appropriate for a speech-like signal, and generating an output usable by a CELP audio decoder to reconstruct the audio signal, the output including LPC parameters, codevectors, and gain factors. The minimizing may minimize the difference between the reconstruction of the audio signal and the audio signal in a closed-loop manner. The measure of the difference may be a perceptually-weighted measure.

According to a variation, the signal or signals derived from codebooks whose excitation outputs are more appropriate for a non-speech-like signal than for a speech-like signal may not be filtered by the linear predictive coding synthesis filter.

The at least one codebook providing an excitation output more appropriate for a speech-like signal than for a non-speech-like signal may include a codebook that produces a noise-like excitation and a codebook that produces a periodic excitation and the at least one other codebook providing an excitation output more appropriate for a non-speech-like signal than for a speech-like signal may include a codebook that produces a sinusoidal excitation useful for emulating a perceptual audio encoder.

The method may further comprise applying a long-term prediction (LTP) analysis to the audio signal to produce LTP parameters, wherein the codebook that produces a periodic excitation is an adaptive codebook controlled by the LTP parameters and receiving as a signal input a time-delayed combination of at least the periodic and the noise-like excitation, and wherein the output further includes the LTP parameters.

The adaptive codebook may receive, selectively, as a signal input, either a time-delayed combination of the periodic excitation, the noise-like excitation, and the sinusoidal excitation or only a time-delayed combination of the periodic excitation and the noise-like excitation, and the output may further include information as to whether the adaptive codebook receives the sinusoidal excitation in the combination of excitations.

The method may further comprise classifying the audio signal into one of a plurality of signal classes, selecting a mode of operation in response to the classifying, and selecting, in an open-loop manner, one or more codebooks exclusively to contribute excitation outputs.

The method may further comprise determining a confidence level to the selecting a mode of operation, wherein there are at least two confidence levels including a high confidence level, and selecting, in an open-loop manner, one or more codebooks exclusively to contribute excitation outputs only when the confidence level is high.

According to another aspect of the present invention, a method for code excited linear prediction (CELP) audio encoding employs an LPC synthesis filter controlled by LPC parameters, a plurality of codebooks each having codevectors, at least one codebook providing an excitation more appropriate for speech-like signals than for non-speech-like signals and at least one other codebook providing an excitation more appropriate for non-speech-like signals than for speech-like signals, and a plurality of gain factors, each associated with a codebook. The method comprises separating an audio signal into speech-like and non-speech-like signal components, applying linear predictive coding (LPC) analysis to the speech-like signal components of the audio signal to produce LPC parameters, minimizing the difference between the LPC synthesis filter output and the speech-like signal components of the audio signal by varying codevector selections and/or gain factors associated with the or each codebook providing an excitation output more appropriate for a speech-like signal than for a non-speech-like signal, varying codevector selections and/or gain factors associated with the or each codebook providing an excitation output more appropriate for a non-speech-like signal than for a speech-like signal, and providing an output usable by a CELP audio decoder to reproduce an approximation of the audio signal, the output including codevector selections and/or gains associated with each codebook, and the LPC parameters. The separating may separate the audio signal into speech-like signal components and non-speech-like signal components.

According to two variations of an alternative, the separating may separate the speech-like signal components from the audio signal and derive an approximation of the non-speech-like signal components by subtracting a reconstruction of the speech-like signal components from the audio signal, or the separating may separate the non-speech-like signal components from the audio signal and derive an approximation of the speech-like signal components by subtracting a reconstruction of the non-speech-like signal components from the audio signal.

A second linear predictive coding (LPC) synthesis filter may be provided and the reconstruction of the non-speech-like signal components may be filtered by such a second linear predictive coding synthesis filter.

The at least one codebook providing an excitation output more appropriate for a speech-like signal than for a non-speech-like signal may include a codebook that produces a noise-like excitation and a codebook that produces a periodic excitation and the at least one other codebook providing an excitation output more appropriate for a non-speech-like signal than for a speech-like signal may include a codebook that produces a sinusoidal excitation useful for emulating a perceptual audio encoder.

The method may further comprise applying a long-term prediction (LTP) analysis to the speech-like signal components of the audio signal to produce LTP parameters, in which case the codebook that produces a periodic excitation may be an adaptive codebook controlled by the LTP parameters and it may receive as a signal input a time-delayed combination of the periodic excitation and the noise-like excitation.

The codebook vector selections and/or gain factors associated with the or each codebook providing an excitation output more appropriate for a non-speech-like signal than for a speech-like signal may be varied in response the speech-like signal.

The codebook vector selections and/or gain factors associated with the or each codebook providing an excitation output more appropriate for a non-speech-like signal than for a speech-like signal may be varied to reduce the difference between the non-speech-like signal and a signal reconstructed from the or each such codebook.

According to a third aspect of the present invention, a method for code excited linear prediction (CELP) audio decoding employs an LPC synthesis filter controlled by LPC parameters, a plurality of codebooks each having codevectors, at least one codebook providing an excitation more appropriate for non-speech-like signals than for speech-like signals and at least one other codebook providing an excitation more appropriate for non-speech-like signals than for speech-like signals, and a plurality of gain factors, each associated with a codebook. The method comprises receiving the parameters, codevectors, and gain factors, deriving an excitation signal for the LPC synthesis filter from at least one codebook excitation output, and deriving an audio output signal from the output of the LPC filter or from the combination of the output of the LPC synthesis filter and the excitation of one or more ones of the codebooks, the combination being controlled by codevectors and/or gain factors associated with each of the codebooks.

The at least one codebook providing an excitation output more appropriate for a speech-like signal than for a non-speech-like signal may include a codebook that produces a noise-like excitation and a codebook that produces a periodic excitation and the at least one other codebook providing an excitation output more appropriate for a non-speech-like signal than for a speech-like signal may include a codebook that produces a sinusoidal excitation useful for emulating a perceptual audio encoder.

The codebook that produces periodic excitation may be an adaptive codebook controlled by the LTP parameters and may receive as a signal input a time-delayed combination of at least the periodic and noise-like excitation, and the method may further comprise receiving LTP parameters.

The excitation of all of the codebooks may be applied to the LPC filter and the adaptive codebook may receive, selectively, as a signal input, either a time-delayed combination of the periodic excitation, the noise-like excitation, and the sinusoidal excitation or only a time-delayed combination of the periodic and the noise-like excitation, and wherein the method may further comprise receiving information as to whether the adaptive codebook receives the sinusoidal excitation in the combination of excitations.

Deriving an audio output signal from the output of the LPC filter may include a postfiltering.

DETAILED DESCRIPTION OF THE INVENTION

Audio Classification Based on Content Analysis

Audio content analysis can help classify an audio segment into one of several audio classes such as speech-like signal, non-speech-like signal, etc. With the knowledge of the type of incoming audio signal, an audio encoder can adapt its coding mode to changing signal characteristics by selecting a mode that may be suitable for a particular audio class.

Given an input audio signal to be data compressed, a first step may be to divide it into signal sample blocks of variable length, where long block length (42.6 milliseconds, in the case of AAC (Advanced Audio Coding) perceptual coding, for example) may be used for stationary parts of the signal, and short block length (5.3 milliseconds, in the case of AAC, for example) may be used for transient parts of the signal or during signal onsets. The AAC sample block lengths are given only by way of example. Particular sample block lengths are not critical to the invention. In principle, optimal sample block lengths may be signal dependent. Alternatively, fixed-length sample blocks may be employed. Each sample block (segment) may then be classified into one of several audio classes such as speech-like, non-speech-like and noise-like. The classifier may also output a confidence measure of the likelihood of the input segment belonging to a particular audio class. As long as the confidence is higher than a threshold, which may be user defined, the audio encoder may be configured with encoding tools suited to encode the identified audio class and such tools may be chosen in an open-loop fashion. For example, if the analyzed input signal is classified as speech-like with high confidence, a multimode audio encoder or encoding function according to aspects of the invention may select a CELP-based speech-like signal coding method to compress a segment. Similarly, if the analyzed input signal is classified as non-speech-like with high confidence, a multimode audio encoder according to aspects of the present invention may select a perceptual transform encoder or encoding function such as AAC, AC-3, or an emulation thereof, to data compress a segment.

On the other-hand, when the confidence of the classifier is low, the encoder may opt for the closed-loop selection of an encoding mode. In a closed-loop selection, the encoder codes the input segment using each of the available coding modes. Given a bit budget, the coding mode that results in the highest perceived quality may be chosen. Obviously, a closed-loop mode selection is computationally more demanding than an open-loop mode selection method. Therefore, the use of confidence measure of the classifiers to switch between open-loop and closed-loop based mode selection results in a hybrid approach to mode selection that saves on computation whenever the classifier confidence is high.

Figure 1:
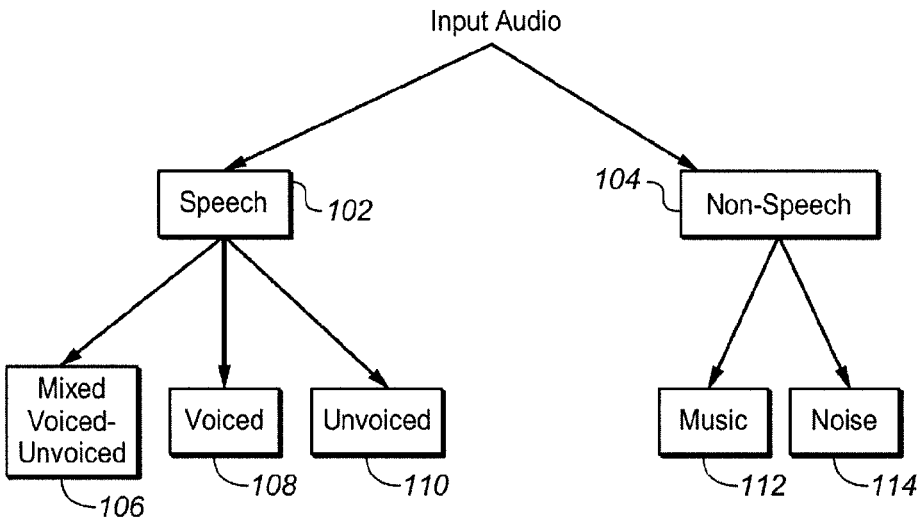
FIGS. 1 and 2 illustrate two examples of audio classification hierarchy decision trees in accordance with aspects of the invention.
Figure 2:
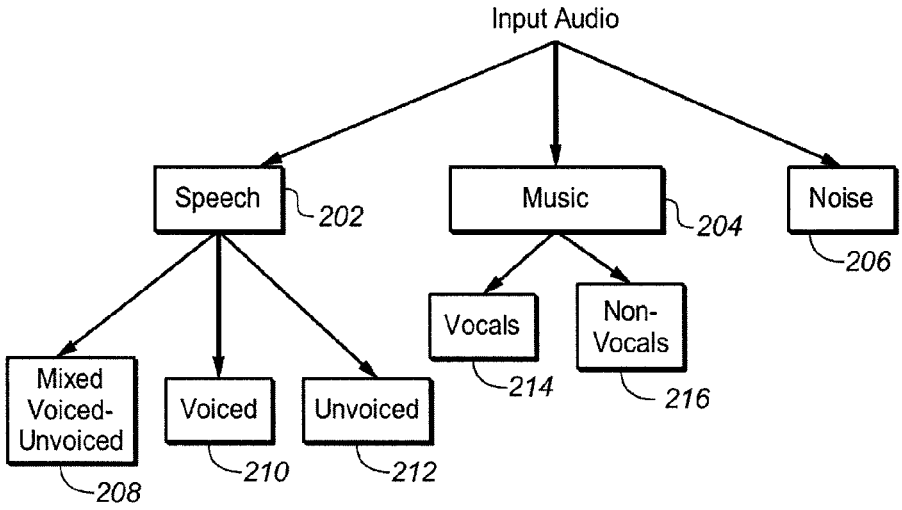

FIGS. 1 and 2 illustrate two examples of audio classification hierarchy decision trees in accordance with aspects of the invention. With respect to each of the example hierarchies, after identifying a particular audio class, the audio encoder preferably selects a coding mode that is suited for that audio class in terms of encoding tools and parameters.

In the FIG. 1 audio classification hierarchy decision tree example, input audio is first identified as a speech-like signal (decision node 102) or a non-speech-like signal (decision node 104) at a first hierarchical level. A speech-like signal is then identified as a mixed voiced speech-like and an unvoiced speech-like signal (decision node 106), a voiced speech-like signal (decision node 108), and an unvoiced speech-like signal (decision node 110) at a lower hierarchical level. A non-speech-like signal is identified as a non-speech-like signal (decision node 112) or noise (114) at the lower hierarchical level. Thus, five classes result: mixed voiced speech-like signal and unvoiced speech-like signal, voiced speech like signal, unvoiced speech-like signal, non-speech-like signal, and noise.

In the FIG. 2 audio classification hierarchy example, input audio is first identified as a speech-like signal (decision node 202), a non-speech-like signal (decision node 204) and noise (decision node 206) at a first hierarchical level. A speech-like signal is then identified as mixed voiced speech like signal and unvoiced speech like signal (208), voiced speech like signal (decision node 210), and unvoiced speech-like signal (decision node 212) at a lower hierarchical level. A non-speech-like signal is identified as vocals (decision node 214), and non-vocals (decision node 216) at the lower hierarchical level. Thus, six classes result: mixed voiced speech-like and unvoiced speech-like signal, voiced speech-like signal, unvoiced speech-like signal, vocals, non-vocals, and noise.

Figure 3:
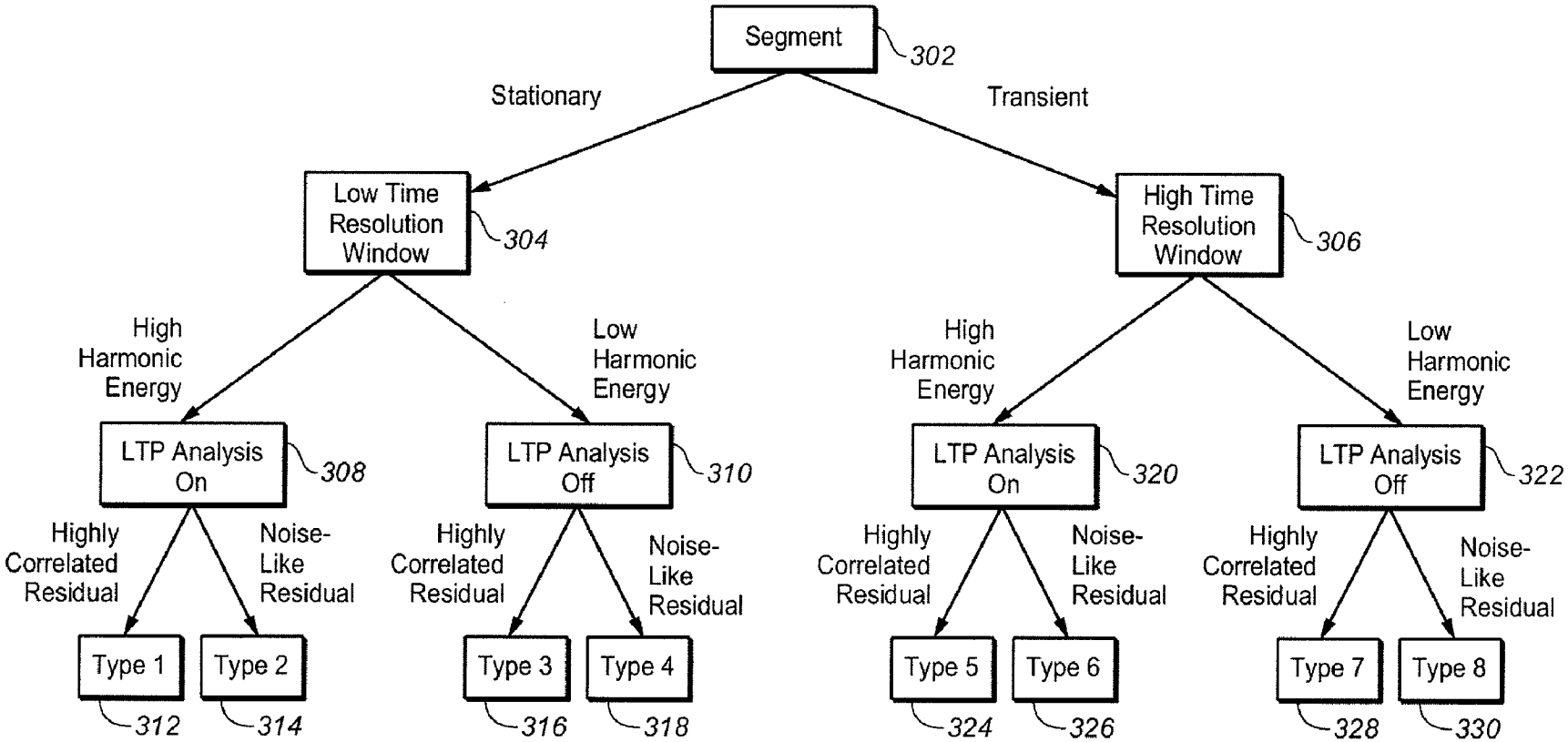
FIG. 3 illustrates a further example of an audio classification hierarchy decision tree in accordance with aspects of the invention in which an audio sample block may be classified into different classes based on its statistics.

Alternatively, it is also possible to classify the audio signal based on its statistics. In particular, different types of audio and speech-like signal encoders and decoders may provide a rich set of signal processing sets such as LPC analysis, LTP analysis, MDCT transform, etc, and in many cases each of these tools may only be suitable for coding a signal with some particular statistical properties. For example, LTP analysis is a very powerful tool for coding signals with strong harmonic energy such as voice segments of a speech-like signal. However, for other signals that do not have strong harmonic energy, applying LTP analysis usually does not lead to any coding gains. An incomplete list of speech-like signal/non-speech-like signal coding tools and the signal types for which they are suitable for and not suitable for is given below in Table. 1. Clearly, for economic bit usage it would be desirable to classify an audio signal segment based on the suitability of the available speech-like signal/non-speech-like signal coding tools, and to assign the right set of the tools for each segment. Thus, a further example of an audio classification hierarchy in accordance with aspects of the invention is shown in FIG. 3. The audio encoder selects a coding mode that is suited for that audio class in terms of coding tools and parameters.

TABLE 1

Speech-like signal/Non-speech-like signal Coding Tools

| Tool | Suitable for | Not suitable for |
|---|---|---|
| LPC (STP) | Signal with non-uniform spectral envelop | White signal |
| LTP | Signal with strong harmonic energy | Signal doesn't have clear harmonic structure |
| MDCT (long window) | Correlated Stationary Signal (energy is compactly represented in transform domain) | Very randomized signal with white spectrum. Transient signal. |
| MDCT (short window) | Short term stationary i.e. Stationarity is preserved only within a short window of time | Very randomized signal with white spectrum. Stationary signal. |
| VQ with noise codebooks | Randomized signal with flat spectrum, with statistics close to the training set of the codebooks. | Other signals |

In accordance with the audio classification hierarchy decision tree example of FIG. 3, an audio sample block may be classified into different types based on its statistics. Each type may be suitable for coding with a particular subset of speech-like signal/non-speech-like signal coding tools or with a combination of them.

Referring to FIG. 3, an audio segment 302 ("Segment") is identified as stationary or transient. A stationary segment is applied to a low-time-resolution window 304 and a transient segment is applied to a high-time-resolution window 306. A windowed stationary segment having high harmonic energy is processed with LTP analysis "on" (308) and a windowed stationary segment having low harmonic energy is processed with LTP analysis "off" (310). When a highly correlated residual results from block 308, the segment is classified as Type 1 (312). When a noise-like residual results from block 308, the segment is classified as Type 2 (314). When a highly correlated residual results from block 310, the segment is classified as Type 3 (316). When a noise-like residual results from block 310, the segment is classified as Type 4 (318).

Continuing the description of FIG. 3, a windowed transient segment having high harmonic energy is processed with LTP analysis "on" (320) and a windowed stationary segment having low harmonic energy is processed with LTP analysis "off" (322). When a highly correlated residual results from block 320, the segment is classified as Type 5 (324). When a noise-like residual results from block 320, the segment is classified as Type 6 (326). When a highly correlated residual results from block 322, the segment is classified as Type 7 (328). When a noise-like residual results from block 322, the segment is classified as Type 8 (330).

Consider the following examples. Type 1: Stationary audio has a dominant harmonic component. When the residual after removal of the dominant harmonic is still correlated between samples, the audio segment may be a voiced speech-like section of a speech-like signal mixed with a non-speech signal background. It may be best to code this signal with a long analysis window with LTP active to remove the harmonic energy, and encode the residual with some a transform coding such as MDCT transform coding. Type 3: Stationary audio with high correlation between samples, but does not have a significant harmonic structure. It may be a non-speech-like signal. Such a signal may be advantageously coded with an MDCT transform coding employing a long analysis window, with or without LPC analysis. Type 7: Transient-like audio waveforms with noise-like statistics within the transient. It may be burst noise in some special sound effects or a stop consonant in a speech-like signal and it may be advantageously encoded with a short analysis window, and VQ (vector quantization) with a Gaussian codebook.

Confidence Measure Driven Switching Between Open-Loop and Closed-Loop Mode Selection After having selected one of the three example audio classification hierarchies illustrated in FIGS. 1-3, one has to build classifiers to detect the chosen signal types based on features extracted from the input audio. Towards that end, training data may be collected for each of the signal types for which a classifier is to be built. For example, several example audio segments that have stationary and high harmonic energy may be collected for detecting the Type 1 signal type of FIG. 3. Let M be the number of features extracted for each audio sample block, based on which classification is to be performed. One may use a Gaussian Mixture Model (GMM) to model the probability density function of the features for a particular signal type. Let Y be an M-dimensional random vector that represents the extracted features. Let K denote the number of Gaussian mixtures with the notations $\pi$, $\mu$ and R denoting the parameter sets for mixture coefficients, means and variances. The complete set of parameters may then be given by K and $\theta=(\pi, \mu, R)$. The log of the probability of the entire sequence $Y_n$ (n=1, 2 . . . N) may be expressed as:

$$\log p_y(y \mid K, \theta) = \sum_{n=1}^{N} \log\left(\sum_{k=1}^{K} p_{y_n}(y_n \mid k, \theta)\pi_k\right) \tag{1}$$

$$p_{y_n}(y_n \mid k, \theta) = \frac{1}{(2\pi)^{\frac{M}{2}} |R|^{\frac{1}{2}}} e^{-\frac{1}{2}(y_n-\mu_k)^T R_k^{-1}(y_n-\mu_k)} \tag{2}$$

where N is the total number feature vectors extracted from the training examples of the particular signal type being modeled. The parameters K and $\theta$ are estimated using an Expectation Maximization algorithm that estimates the parameters that maximize the likelihood of the data (expressed in equation (1)).

Once the model parameters for each signal type are learned during training, the likelihood of an input feature vector (to be classified for a new audio segment) under all trained models is computed. The input audio segment may be classified as belonging to one of the signal types based on maximum likelihood criterion. The likelihood of the input audio's feature vector also acts as a confidence measure.

In general, one may collect training data for each of the signal types and extract a set of features to represent audio segments. Then, using a machine learning method (generative (GMM) or discriminative (Support Vector Machine)), one may model the decision boundary between the signal types in the chosen feature space. Finally, for any new input audio segment one may measure how far it is from the learned decision boundary and use that to represent confidence in the classification decision. For instance, one may be less confident about a classification decision on an input feature vector that is closer to a decision boundary than for a feature vector that is farther away from a decision boundary.

Using a user-defined threshold on such a confidence measure, one may opt for open-loop mode selection when the confidence on the detected signal type is high and for closed-loop otherwise.

Figure 4A:
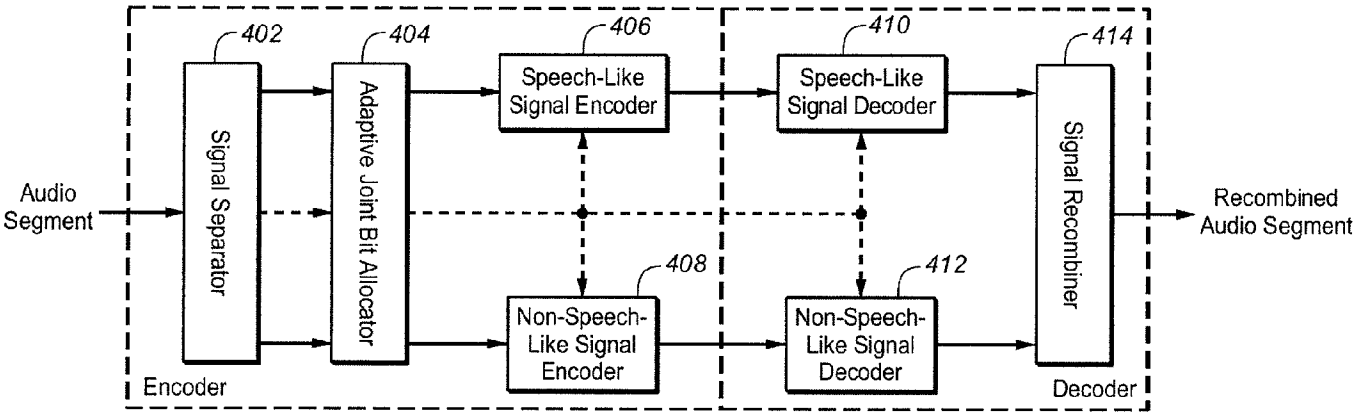
FIG. 4*a* is a schematic conceptual block diagram of an encoder and decoder method or device according to aspects of the invention showing a way in which a combination speech-like and non-speech-like signal may be separated in an encoder into speech-like and non-speech-like signal components and encoded by respective speech-like signal and non-speech-like signal encoders and then, in a decoder, decoded in respective speech-like signal and non-speech-like signal decoders and recombined.

Speech-Like-Signal Audio Coding Using Signal Separation Combined with Multimode Coding A further aspect of the present invention includes the separation of an audio segment into one or more signal components. The audio within a segment often contains, for example, a mixture of speech-like signal components and non-speech-like signal components or speech-like signal components and background noise components. In such cases, it may be advantageous to code the speech-like signal components with encoding tools more suited to a speech-like signal than to a non-speech-like signal, and the non-speech-like signal or background components with encoding tools more suited to a non-speech-like signal components or background noise than to a speech-like signal. In a decoder, the component signals may be decoded separately and then recombined. In order to maximize the efficiency of such encoding tools, it may be preferable to analyze the component signals and dynamically allocate bits between or among encoding tools based on component signal characteristics. For example, when the input signal consists of a pure speech-like signal, the adaptive joint bit allocation may allocate as many bits as possible to the speech-like signal encoding tool and as few bits as possible to the non-speech-like signal encoding tool. To assist with determining an optimal allocation of bits, it is possible to use information from the signal separation device or function in addition to the component signals themselves. A simple diagram of such a system is shown in FIG. 4*a*. A variation thereof is shown in FIG. 4*b*.

As seen in FIG. 4*a*, the speech-like signal and non-speech-like signal components within an audio segment are first separated by a signal separating device or function ("Signal Separator") 402, and subsequently coded using encoding tools specifically intended for those types of signal. Bits may be allocated to the encoding tools by an adaptive joint bit allocation function or device ("Adaptive Joint Bit Allocator") 404 based on characteristics of the components signals as well as information from the Signal Separator 402. Although FIG. 4*a* shows a separation into two components, it will be understood by those skilled in the art that Signal Separator 402 may separate the signal into more than two components, or separate the signal into components different from those shown in FIG. 4*a*. It should also be noted that the method of signal separation is not critical to the present invention, and that any method of signal separation may be used. The separated speech-like signal components and information including bit allocation information for them are applied to a speech-like signal encoder or encoding function ("Speech-Like Signal Encoder") 406. The separated non-speech-like signal components and information, including bit allocation for them, are applied to a non-speech-like signal encoder or encoding function ("Non-Speech-Like Signal Encoder") 408. The encoded speech-like signal, encoded non-speech-like signal and information, including bit allocation for them, are outputted from the encoder and sent to a decoder in which a speech-like signal decoder or decoding function ("Speech-Like Signal Decoder") 410 decodes the speech-like signal components and a non-speech-like signal decoder or decoding function ("Non-Speech-Like Signal Decoder") 412 decodes the non-speech-like signal components. A signal recombining device or function ("Signal Recombiner") 414 receives the speech-like signal and non-speech-like signal components and recombines them. In a preferred embodiment, Signal Recombiner 414 linearly combines the component signals, but other ways of combining the component signals, such as a power-preservation combination, are also possible and are included within the scope of the present invention.

Figure 4B:
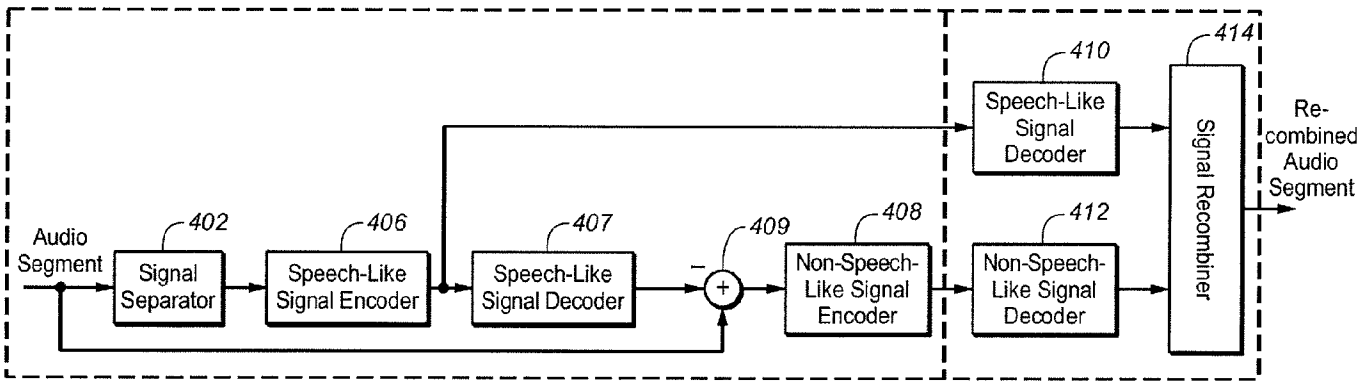
FIG. 4*b* is a schematic conceptual block diagram of an encoder and decoder method or device according to aspects of the invention in which the signal separation is implemented in an alternative manner from that of FIG. 4*a*.

A variation of the FIG. 4*a* example is shown in the example of FIG. 4*b*. In FIG. 4*b*, the speech-like signal within a segment is separated from the input combined speech-like and non-speech-like signal by a signal separating device or function ("Signal Separator") 402' (which differs from Signal Separator 402 in that it only needs to output one signal component and not two). The separated speech-like signal component is then coded using encoding tools ("Speech Encoder") 406 specifically intended for speech-like signals. A fixed number of bits may be allocated for the speech-like signal encoding. In the FIG. 4*b* variation, the non-speech-like signal components are obtained by decoding the encoded speech-like signal components in a speech decoding device or process ("Speech-Like Signal Decoder") 407, which is complementary to Speech-Like Signal Encoder 406, and subtracting those signal components from the combined input signal (a linear subtractor device or function is shown schematically at 409). The non-speech signal components resulting from the subtraction operation are applied to a non-speech-like signal-encoding device or function ("Non-Speech-Like Signal Encoder") 408'. Encoder 408' may use whatever bits were not used by Encoder 406. Alternatively, Signal Separator 402' may separate out the non-speech-like signal components and those signal components, after decoding, may be subtracted from the combined input signal in order to obtain the speech-like signal components. The encoded speech-like signal, encoded non-speech-like signal and information, including bit allocation for them, are outputted from the encoder and sent to a decoder in which a speech-like signal decoder or decoding function ("Speech-Like Signal Decoder") 410 decodes the speech-like signal components and a non-speech-like signal decoder or decoding function ("Non-Speech-Like Signal Decoder") 412 decodes the non-speech-like signal components. A signal recombining device or function ("Signal Recombiner") 414 receives the speech-like signal and non-speech-like signal components and recombines them. In a preferred embodiment, Signal Recombiner 414 linearly combines the component signals, but other ways of combining the component signals, such as a power-preservation combination, are also possible and are included within the scope of the present invention.

Figure 5A:
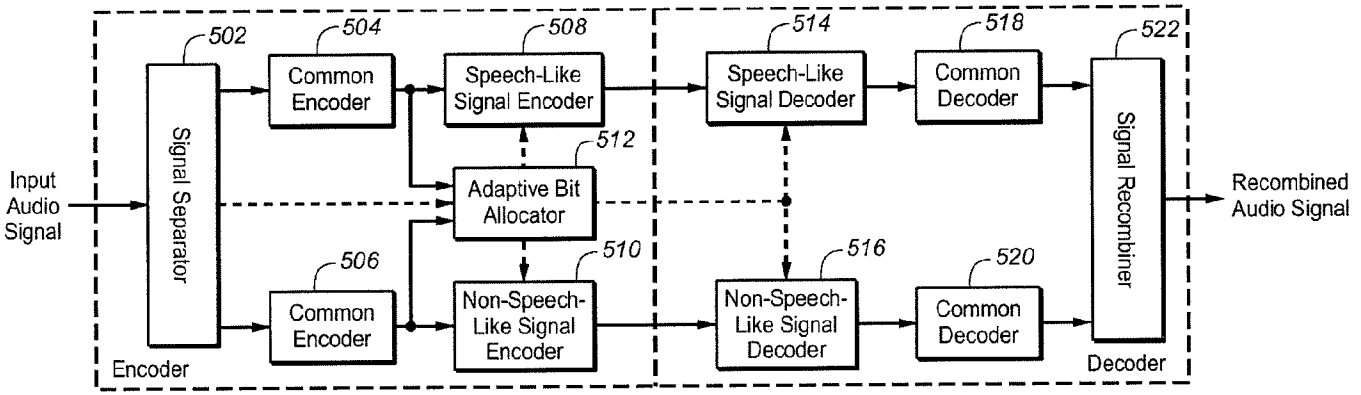
FIG. 5*a* is a schematic conceptual functional block diagram of an encoder and decoder method or device according to aspects of the invention showing a modification of the arrangement of FIG. 4*a* in which functions common to the speech-like signal encoder and non-speech-like signal encoder are separated from the respective encoders.
Figure 5B:
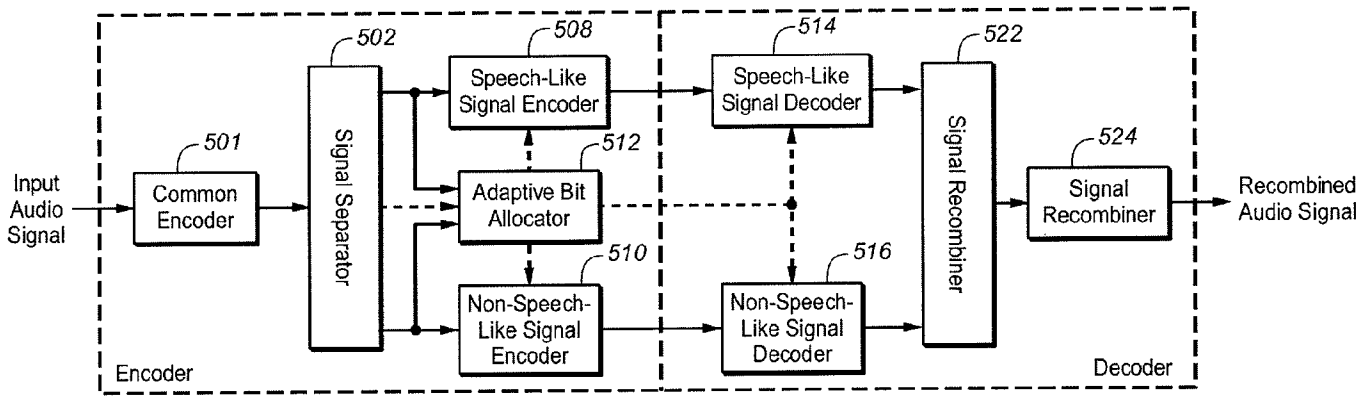
FIG. 5*b* is a schematic conceptual functional block diagram of an encoder and decoder method or device according to aspects of the invention showing a modification of the arrangement of FIG. 5*a* in which elements common to each of the speech-like signal encoder and non-speech-like signal encoder are separated from the respective encoders so as to, in the encoder, process the combined speech-like and non-speech-like signal before it is separated into speech-like and non-speech-like signal components, and, in the decoder, commonly decode a partially decoded combined signal.

Although the examples of FIGS. 4*a* and 4*b* show a unique encoding tool being used for each component signal, in many cases using one or more than one encoding tool may be beneficial to the processing of each of the multiple component signals. It is another aspect of the invention that in such cases, rather than perform redundant operations on each component signal as may occur in the arrangement of FIG. 5*a*, common encoding tools may be applied to the combined signal prior to separation and the unique encoding tools may then be applied to component signals after separation, as shown in FIG. 5*b*. The separation may occur in either of two ways. One way is direct separation (as shown, for example, in FIG. 4*a* and FIG. 7*c*). In the case of direct separation, the sum of the separated speech-like signal and non-speech-like signal components before encoding equals the original input signal. According to another way (as shown, for example, in FIG. 4*b* and FIG. 7*d*), the input to the non-speech-like signal-encoding encoding tool may be generated as the difference between the input signal and the (reconstructed) encoded/ decoded speech-like signal (or, alternatively, the difference between the input signal and the (reconstructed) encoded/decoded non-speech-like signal). In either case, speech-like signal and non-speech-like signal encoding tools may be integrated into a common framework, allowing joint optimization of a single perceptually-motivated distortion criterion. Examples of such an integrated framework are shown in FIGS. 7*a*-7*d*.

Although the specific type of processing performed by a common encoding tool is not critical to the invention, one exemplary form of a common coding encoding tool is audio bandwidth extension. Many methods of audio bandwidth extension are known from the art, and are suitable for use with this invention. Furthermore, while FIG. 5*a* shows only a single common encoding tool, it should be understood that in some cases it may be useful to use more than one common encoding tool. Finally, as with the system shown in FIG. 4*a*, the arrangements shown in FIGS. 5*a* and 5*b* contain an adaptive joint bit allocation function or device to maximize the efficiency of the encoding tools based on the component signal characteristics.

Referring to FIG. 5*a*, in this example, a Signal Separator 502 (comparable to Signal Separator 402 of FIG. 4*a*) separates an input signal into speech-like signal and non-speech-like signal components. FIG. 5*a* differs from FIG. 4*a* principally in the presence of a common encoder or encoding function ("Common Encoder") 504 and 506 that processes the respective speech-like signal and non-speech-like signal components before they are applied to a speech-like signal encoder or encoding function ("Speech-Like Signal Encoder") 508 and to a non-speech-like signal encoder or encoding function ("Non-Speech-Like Signal Encoder") 510. The Common Encoders 504 and 506 may provide encoding for the portion of the Speech-Like Signal Encoder 406 (FIG. 4*a*) and the portion of the Non-Speech-Like Signal Encoder 408 (FIG. 4*a*) that are common to each other. Thus, the Speech-Like Signal Encoder 508 and the Non-Speech-Like Signal Encoder 510 differ from the Speech-Like Signal Encoder 406 and the Non-Speech-Like Signal Encoder 408 of FIG. 4*a* in that they do not have the encoder or encoding function(s) that are common to encoders 406 and 408. An Adaptive Bit Allocator (comparable to Adaptive Bit Allocator 404 of FIG. 4*a*) receives information from Signal Separator 502 and also the signal outputs of the Common Encoders 504 and 506. The encoded speech-like signal, encoded non-speech-like signal and information including bit allocation for them are outputted from the encoder of FIG. 5*a* and sent to a decoder in which a speech-like signal decoder or decoding function ("Speech-Like Signal Decoder") 514 partially decodes the speech-like signal components and a non-speech-like signal decoder or decoding function ("Non-Speech-Like Signal Decoder") 516 partially decodes the non-speech-like signal components. A first and a second common decoder or decoding function ("Common Decoder") 518 and 520 complete the speech-like signal and non-speech-like signal decoding. The Common Decoders provide decoding for the portion of the Speech-Like Signal Decoder 410 (FIG. 4) and the portion of the Non-Speech-Like signal Decoder 412 (FIG. 4) that are common to each other. A signal recombining device or function ("Signal Recombiner") 522 receives the speech-like signal and non-speech-like signal components and recombines them in the manner of Recombiner 414 of FIG. 4.

Referring to FIG. 5*b*, this example differs from the example of FIG. 5*a* in that a common encoder or encoding function ("Common Encoder") 501 is located before Signal Separator 502 and a common decoder or decoding function ("Common Decoder") 524 is located after Signal Recombiner 524. Thus, the redundancy of employing two substantially identical common encoders and two substantially identical common decoders is avoided.

Implementation of a Signal Separator

Figure 6:
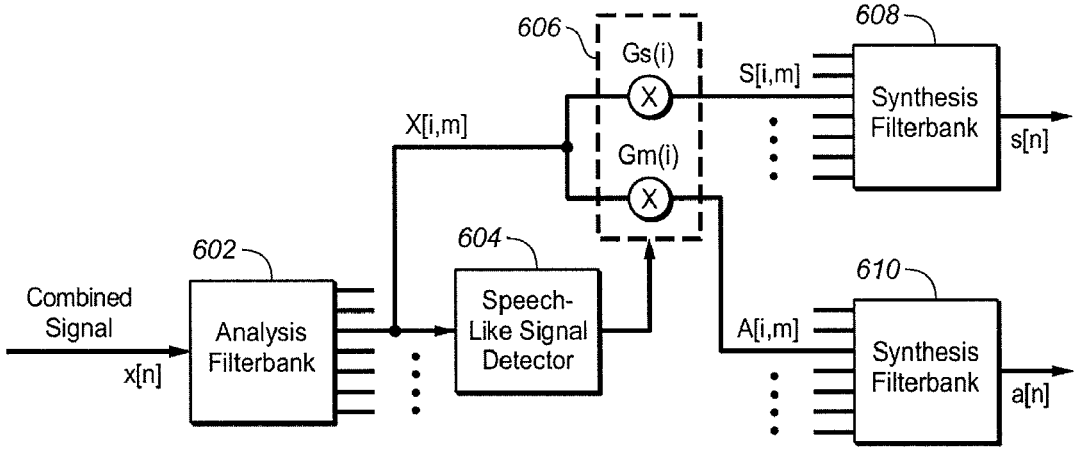
FIG. 6 is a schematic conceptual functional block diagram of a frequency-analysis-based signal separation method or device that may be usable to implement the signal separation device or function shown in FIGS. 4, 5*a*, 5*b*, 7*c*, and 7*d*.

Blind source separation ("BSS") technologies that can be used to separate speech-like signal components and non-speech-like signal components from their combination are known in the art [see, for example, reference 7 cited below]. In general, these technologies may be incorporated into this invention to implement the signal separation device or function shown in FIGS. 4, 5*a*, 5*b* and 7*c*. In FIG. 6 a frequency-analysis-based signal separation method or device is described. Such a method or device may also be employed in an embodiment of the present invention to implement the signal separation device or function shown in FIGS. 4, 5*a*, 5*b* and 7*c*. In the method or device of FIG. 6, a combined speech-like signal/non-speech-like signal x[n] is transformed into the frequency domain by using an analysis filterbank or filterbank function ("Analysis Filterbank") 602 producing outputs X[i,m] (where "i" is the band index and "m" is a sample signal block index). For each frequency band i, a speech-like signal detector is used to determine the likelihood that a speech-like signal is contained in this frequency band. A pair of separation gain factors having a value between 0 and 1 is determined by the speech-like signal detector according to the likelihood. Usually, a value closer to 1 than to 0 may be assigned to the speech-like signal gain Gs(i) if there may be large likelihood that subband i contains strong energy from a speech-like signal and otherwise a value closer to 0 than to 1 may be assigned. The non-speech-like signal gain Gm(i) may be assigned following an opposite rule. Application of the speech-like signal and non-speech-like signal gains is shown schematically by the application of the Speech-Like Signal Detector 604 output to multiplier symbols in block 606. These respective separation gains are applied to the frequency band signals X[i,m] and the resulting signals are inverse transformed into the time domain by respective synthesis filterbanks or filterbank functions ("Synthesis Filterbank") 608 and 610 to produce the separated speech-like signal and non-speech-like signal, respectively.

Unified Multimode Audio Encoder

Figure 7A:
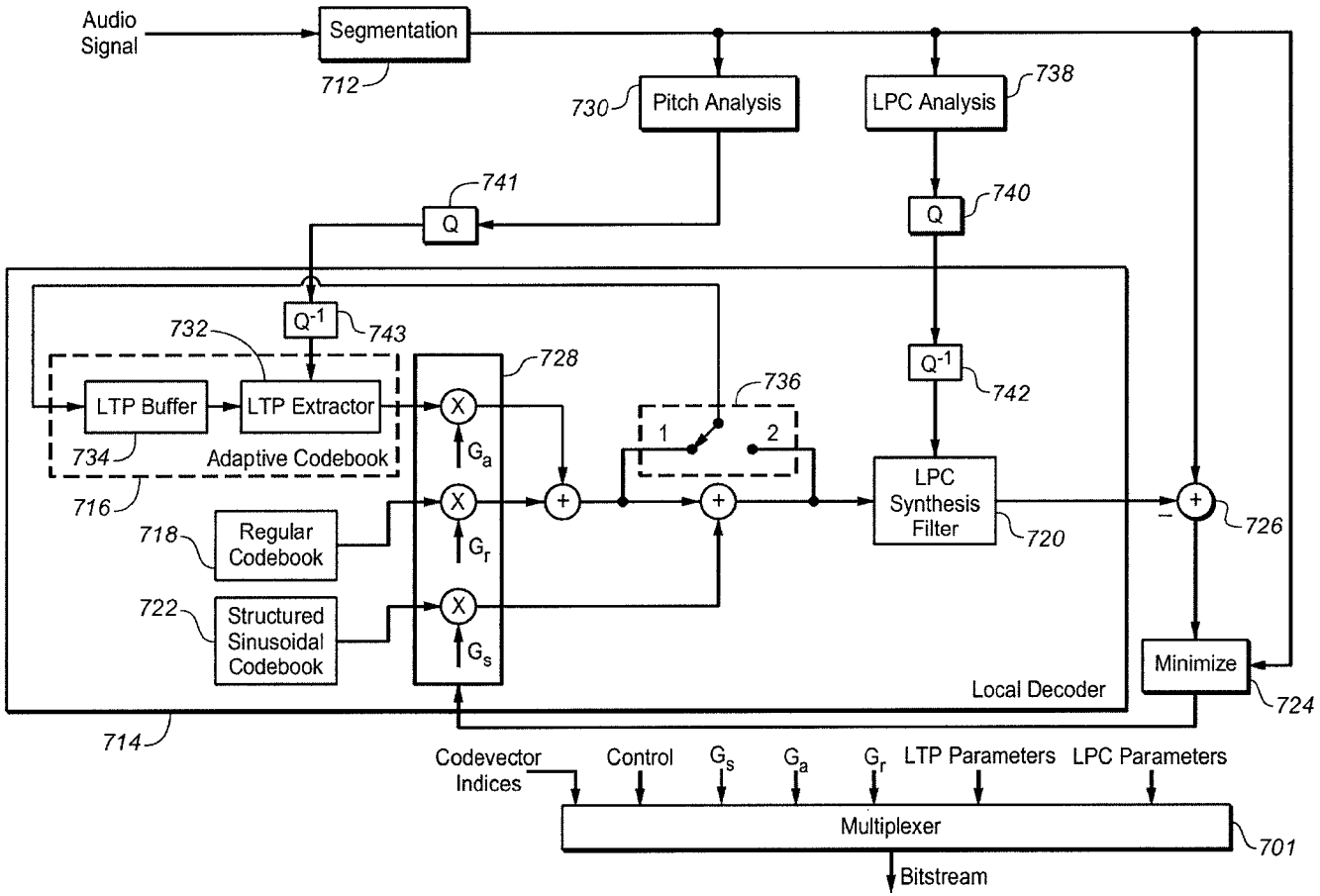
FIG. 7*a* is a schematic conceptual functional block diagram of a first variation of an example of a unified speech-like signal/non-speech-like signal encoder according to aspects of the present invention. In this variation, the selection of encoding tools and their parameters may be decided by minimizing the overall reconstruction error in a closed-loop manner.
Figure 7B:
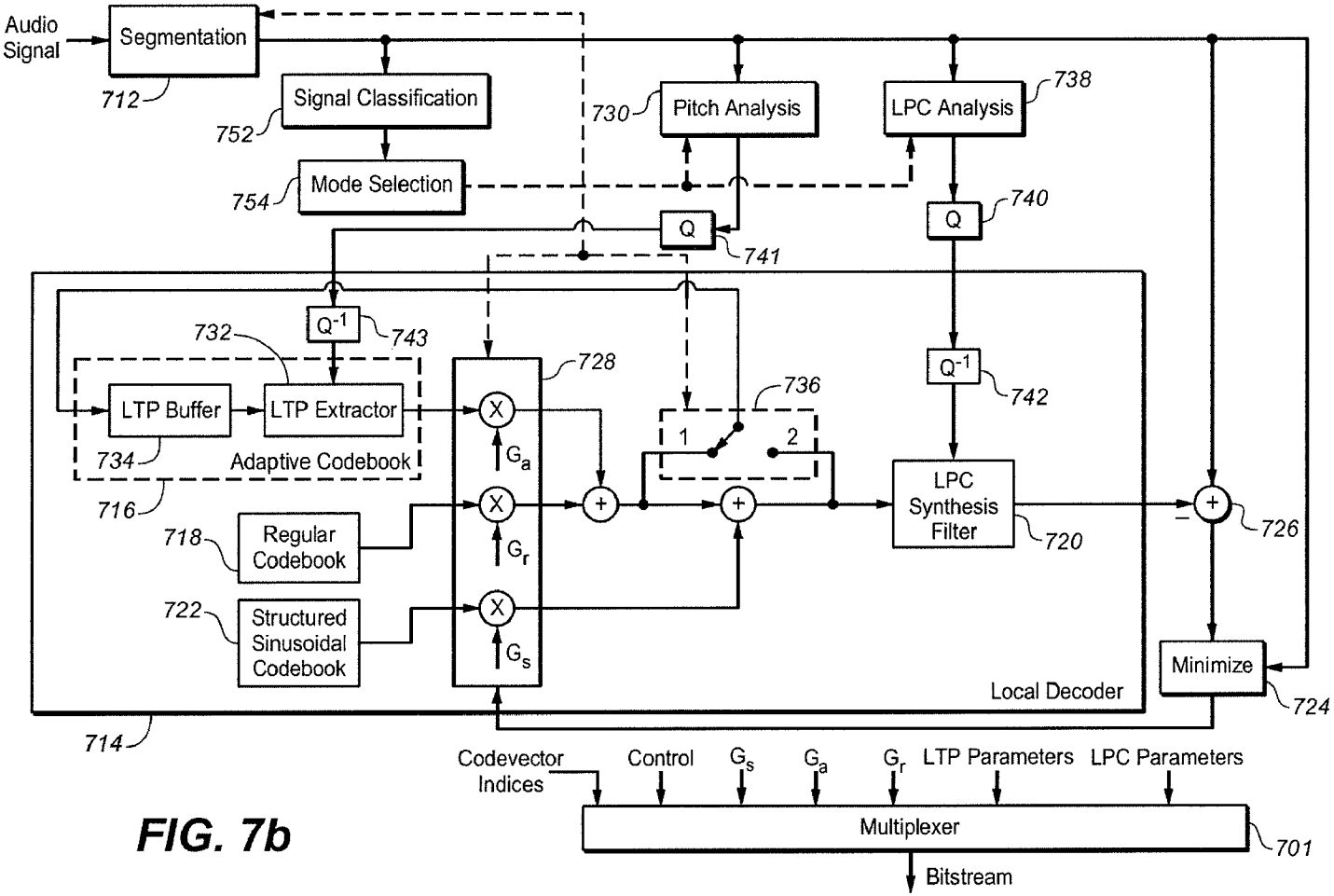
FIG. 7*b* is a schematic conceptual functional block diagram of a second variation of an example of a unified speech-like signal/non-speech-like signal encoder according to aspects of the present invention. In this variation, the selection of encoding tools is determined by a mode selection tool that operates in response to signal classification results. Parameters may be decided by minimizing the overall reconstruction error in a closed-loop manner as in the example of FIG. 7*a*.
Figure 7C:
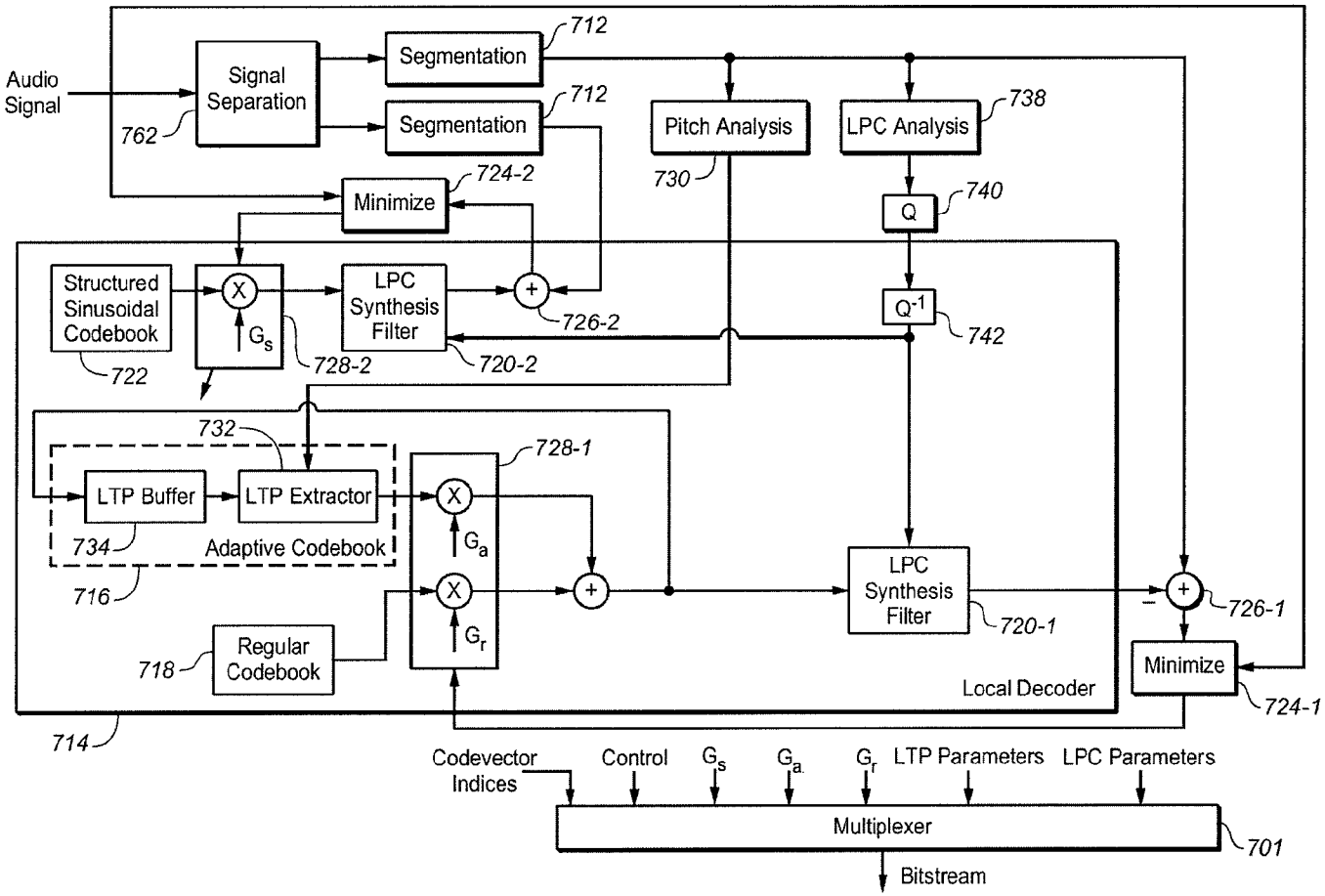
FIG. 7*c* is a schematic conceptual functional block diagram of a third variation of an example of a unified speech-like signal/non-speech-like signal encoder according to aspects of the present invention. In this variation, signal separation is employed.
Figure 7D:
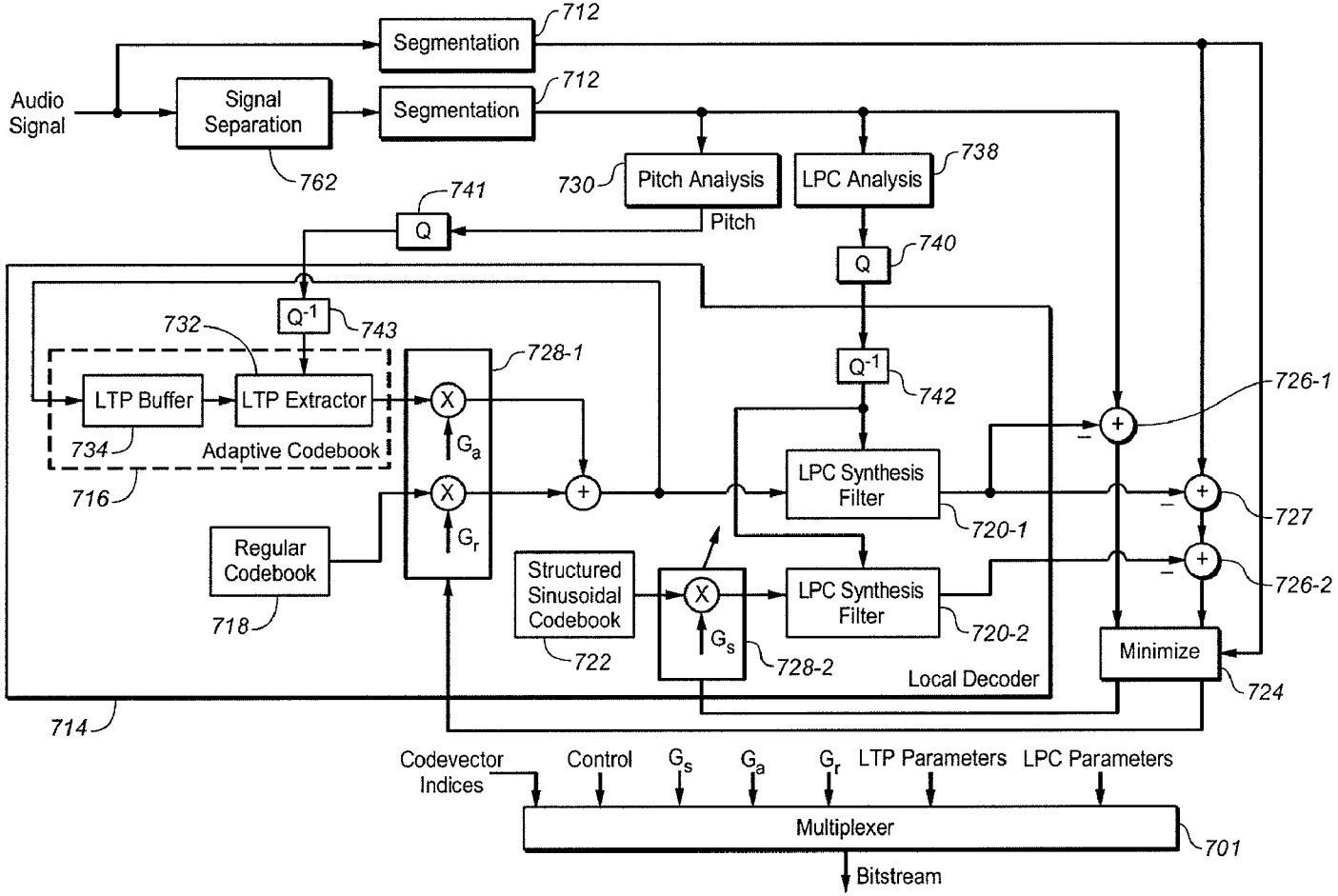
FIG. 7*d* is a schematic conceptual functional block diagram showing a variation of FIG. 7*c* in which the separation paths are interdependent (in the manner of FIG. 4*b*).

A unified multimode audio encoder according to aspects of the present invention has various encoding tools in order to handle different input signals. Three different ways to select the tools and their parameters for a given input signal are as follows:

1) by using a closed-loop perceptual error minimization process (FIG. 7*a*, described below).
2) by using signal classification technology, described above, and determining the tools based on the classification result (FIG. 7*b*, described below).
3) by using signal separation technology, described above, and sending the separated signals to different tools (FIGS. 7*c* and 7*d*, described below). A signal separation tool may be added to separate the input signal into a speech-like signal component stream and a non-speech-like signal component stream.

A first variation of an example of a unified speech-like signal/non-speech-like signal encoder according to aspects of the present invention is shown in FIG. 7*a*. In this variation, the selection of encoding tools and their parameters may be decided by minimizing the overall reconstruction error in a closed-loop manner.

Referring to the details of the FIG. 7*a* example, an input speech-like signal/non-speech-like signal, which may be in PCM (pulse code modulation) format, for example, is applied to "Segmentation" 712, a function or device that divides the input signal into signal sample blocks of variable length, where long block length is used for stationary parts of the signal, and short block length may be used for transient parts of the signal or during signal onsets. Such variable block length segmentation is, by itself, well known in the art. Alternatively, fixed-length sample blocks may be employed.

For the purposes of understanding its operation, the encoder example of FIG. 7*a* may be considered to be a modified CELP encoder employing closed-loop analysis-by-synthesis techniques. As in conventional CELP encoders, a local decoder or decoding function ("Local decoder") 714 is provided that includes an adaptive codebook or codebook function ("Adaptive codebook") 716, a regular codebook or codebook function ("Regular codebook") 718, and an LPC synthesis filter ("LPC Synthesis Filter") 720. The regular codebook contributes to coding of "unvoiced" speech-like random-noise-like portions of an applied signal with no periodicity, and a pitch adaptive codebook contributes to coding "voiced" speech-like portions of an applied signal having a strong periodic component. Unlike conventional CELP encoders, the encoder of this example also employs a structured sinusoidal codebook or codebook function ("Structured Sinusoidal Codebook") 722 that contributes to coding of non-speech-like portions of an applied signal such as music from multiple instruments and mixed speech from (human) speakers of different pitches. Further details of the codebooks are set forth below.

Also unlike conventional CELP encoders, the closed-loop control of gain vectors associated with each of the codebooks ($G_a$ for the adaptive codebook, $G_r$ for the regular codebook, and $G_s$ for the structured sinusoidal codebook) allows the selection of variable proportions of the excitations from all of the codebooks. The control loop includes a "Minimize" device or function 724 that, in the case of the Regular Codebook 718, selects an excitation codevector and a scalar gain factor $G_r$ for that vector, in the case of the Adaptive Codebook 716, selects a scalar gain factor $G_a$ for an excitation codevector resulting from the applied LTP pitch parameters and inputs to the LTP Buffer, and, in the case of the Structured Sinusoidal Codebook, selects a vector of gain values $G_s$ (every sinusoidal code vector may, in principle, contribute to the excitation signal) so as to minimize the difference between the LPC Synthesis Filter (device or function) 720 residual signal and the applied input signal (the difference is derived in subtractor device or function 726), using, for example, a minimum-squared-error technique. Adjustment of the codebook gains $G_a$, $G_r$, and $G_s$ is shown schematically by the arrow applied to block 728. For simplicity in presentation in this and other figures, selection of codebook codevectors is not shown. Calculate MSE (mean squared error) device or function ("Minimize") 724 operates so as to minimize the distortion between the original signal and the locally decoded signal in a perceptually meaningful way by employing a psychoacoustic model that receives the input signal as a reference. As explained further below, a closed-loop search may be practical for only the regular and adaptive codebook scalar gains and an open-loop technique may be required for the structured sinusoidal codebook gain vector in view of the large number of gains that my contribute to the sinusoidal excitation.

Other conventional CELP elements in the example of FIG. 7*a* include a pitch analysis device or function ("Pitch Analysis") 730 that analyzes the segmented input signal and applies a measure of pitch period to an LTP (long term prediction) extractor device or function ("LTP Extractor") 732 in the adaptive codebook 716. The pitch parameters are quantized and may also be encoded (entropy encoding, for example) by a quantizing device or function ("Q") 741. In the local decoder, the quantized and perhaps encoded parameters are dequantized by a dequantizing device or function ("$Q^{-1}$") 743, decoded if necessary, and then applied to the LTP Extractor 732. The adaptive codebook 716 also includes an LTP buffer or memory 734 device or function ("LTP Buffer") that receives as its input either (1) a combination of the adaptive codebook and regular codebook excitations or (2) a combination of the adaptive codebook, regular codebook and structural sinusoidal codebook excitations. The selection of excitation combination (1) or combination (2) is shown schematically by a switch 736. The selection of combination (1) or combination (2) may be determined by the closed-loop minimization along with its determination of gain vectors. As in a conventional CELP encoder, the LPC Synthesis Filter 720 parameters may be obtained by analyzing the segmented applied input signal with an LPC analysis device or function ("LPC Analysis") 738. Those parameters are then quantized and may also be encoded (entropy encoding, for example) by a quantizing device or function ("Q") 740. In the local decoder, the quantized and perhaps encoded parameters are dequantized by a dequantizing device or function ("$Q^{-1}$") 742, decoded if necessary, and then applied to the LPC Synthesis Filter 720. Similarly, the LTP parameters may be quantized and may also be encoded (entropy encoding, for example) by a quantizing device or function ("Q") 741. In the local decoder, the quantized and perhaps encoded parameters are dequantized by a dequantizing device or function ("$Q^{-1}$") 743, decoded if necessary, and then applied to the LTP Extractor 732.

The output bitstream of the FIG. 7*a* example may include at least (1) a Control signal, which in this example may only the position of switch 736, the scalar gains $G_a$ and $G_r$, and vector of gain values $G_s$, Regular Codebook and Adaptive Codebook excitation codevector indices, the LTP parameters from Pitch Analysis 730, and the LPC parameters from LPC analysis 738. The frequency of bitstream updating may be signal dependent. In practice it may be useful to update the bitstream components at the same rate as the signal segmentation Typically, such information is formatted in a suitable way, multiplexed and entropy coded into a bitstream by a suitable device or function ("Multiplexer") 701. Any other suitable way of conveying such information to a decoder may be employed.

In an alternative to the example of FIG. 7*a*, the gain-adjusted output of the Structured Sinusoidal Codebook may be combined with the output of LPC Synthesis Filter 720 rather than being combined with the other codebook excitations before being applied to Filter 720. In this case, the Switch 736 has no effect. Also, as is explained further below, this alternative requires the use of a modified decoder.

A second variation of an example of a unified speech-like signal/non-speech-like signal encoder according to aspects of the present invention is shown in FIG. 7*b*. In this variation, the selection of encoding tools is determined by a mode selection tool that operates in response to signal classification results. Parameters may be decided by minimizing the overall reconstruction error in a closed-loop manner as in the example of FIG. 7*a*.

For simplicity in exposition, only the differences between the example of FIG. 7*b* and the example of FIG. 7*a* will be described. Devices or functions corresponding generally to those in FIG. 7*a* retain the same reference numerals in FIG. 7*b*. Some differences between certain generally corresponding devices or functions are explained below.

The example of FIG. 7*b* includes a signal classification device or function ("Signal Classification") 752 that has the segmented input speech-like signal/non-speech-like signal applied to it. Signal Classification 752 employs one of the above described classification schemes described in connection with FIGS. 1-3, or any other suitable classification scheme to identify a class of signal. Signal Classification 752 also determines the level of confidence of its selection of a class of signal. There may be two levels of confidence, a high level and a low level. A mode selection device or function ("Mode Selection") 754 receives the class of signal and the confidence level information, and, when the confidence is high, based on the class, identifies one or more codebooks to be employed, selecting one or two and excluding the other or others. Mode Selection 754 also selects the position of Switch 736 when the confidence level is high. The selection of the codebook gain vectors of the open-loop selected codebooks is then made in a closed-loop manner. When the Mode Selection 754 confidence level is low, the example of FIG. 7*b* operates in the same way as the example of FIG. 7*a*. Mode Selection 754 may also switch off either or both of the Pitch (LTP) analysis and LPC analysis (for example, when the signal does not have a significant pitch pattern).

The output bitstream of the FIG. 7*b* example may include at least (1) a Control signal, which in this example may include a selection of one or more codebooks, the proportion of each, and also the position of switch 736, the gains $G_a$, $G_r$, and $G_s$, the codebook codevector indices, the LTP parameters from Pitch analysis 730, and the LPC parameters from LPC analysis 738. Typically, such information is formatted in a suitable way, multiplexed and entropy coded into a bitstream by a suitable device or function ("Multiplexer") 701. Any other suitable way of conveying such information to a decoder may be employed. The frequency of bitstream updating may be signal dependent. In practice it may be useful to update the bitstream components at the same rate as the signal segmentation.

As with respect to the encoder of the example of FIG. 7*a*, the encoder of the FIG. 7*b* example has the additional flexibility to determine whether or not to include the contribution from the Structural Sinusoidal Codebook 722 in the past excitation signal. The decision can be made in an open-loop manner or a closed-loop manner. In the closed-loop manner (as in the FIG. 7*a* example) the encoder tries to use past excitation signals that are with and that are without the contribution from the Structural Sinusoidal Codebook, and chooses the excitation signal that gives the better coding result. In the open-loop manner, the decision is made by the Mode Selection 54, based on the result of the signal classification.

In an alternative to the example of FIG. 7*b*, the gain-adjusted output of the Structured Sinusoidal Codebook may be combined with the output of LPC Synthesis Filter 720 rather than being combined with the other codebook excitations before being applied to Filter 720. In this case, the Switch 736 has no effect. Also, as is explained further below, this alternative requires the use of a modified decoder.

A third variation of an example of a unified speech-like signal/non-speech-like signal encoder according to aspects of the present invention is shown in FIGS. 7*c* and 7*d*. In these variations, signal separation is employed. In the sub variation of FIG. 7*c*, the separation paths are independent (in the manner of FIG. 4*a*), whereas in the sub variation of FIG. 7*d*, the separation paths are interdependent (in the manner of FIG. 4*b*). For simplicity in exposition, only the differences between the example of FIG. 7*c* and the example of FIG. 7*a* will be described. Also, for simplicity in exposition, in the description of FIG. 7*d* below, only the differences between the example of FIG. 7*d* and the example of FIG. 7*c* will be described. Devices or functions corresponding generally to those in FIG. 7*a* retain the same reference numerals in FIGS. 7*c* and 7*d*. In both the FIG. 7*c* and FIG. 7*d* descriptions, some differences between certain corresponding devices or functions are explained below.

Referring to the details of the FIG. 7*c* example, an input speech-like signal/non-speech-like signal, which may be in PCM format, for example, is applied to a signal separator or signal separating function ("Signal Separation") 762 that separates the input signal into speech-like signal and non-speech-like signal components. A separator such as shown in FIG. 6 or any other suitable signal components separator may be employed. Signal Separation 762 inherently includes functions similar to Mode Selection 754 of FIG. 7*b*. Thus, Signal Separation 762 may generate a Control signal (not shown in FIG. 7*c*) in the manner of the Control signal generated by Mode Selection 754 in FIG. 7*b*. Such a Control signal may have the ability to turn off one or more codebooks based on signal separation results.

Because of the separation of speech-like signal and non-speech-like signal components, the topology of FIG. 7*c* differs somewhat from that of FIG. 7*a*. For example, the closed-loop minimization associated with the Structured Sinusoidal Codebook is separate from the closed-loop minimization associated with the Adaptive and Regular Codebooks. Each of the separated signals from Signal Separator 762 is applied to its own Segmentation 712. Alternatively, one Segmentation 712 may be employed before Signal Separation 762. However, the use of multiple Segmentations 712, as shown, has the advantage of permitting each of the separated and segmented signals to have its own sample block length. Thus, as shown in FIG. 7*c*, the segmented speech-like signal components are applied to the Pitch Analysis 730 and the LPC Analysis 738. The Pitch Analysis 730 pitch output is applied via Quantizer 740 and Dequantizer 742 to the LTP Extractor 732 in the Adaptive Codebook 716 in the Local Decoder 714' (a prime mark indicating a modified element). The LPC Analysis 738 parameters are quantized (and perhaps encoded) by Quantizer 740 and then de-quantized (and decoded, if necessary) in Dequantizer 742. The resulting LPC parameters are applied to a first and a second occurrence of LPC Synthesis Filter 720, indicated as 720-1 and 720-2. One occurrence of the LPC Filter, designated as 720-2, is associated with excitation from the Structured Sinusoidal Codebook 722 and the other (designated as 720-1) is associated with the excitation from the Regular Codebook 716 and the Adaptive Codebooks 718. Multiple occurrences of the LPC Synthesis Filter 720 and its associated closed-loop elements result from the signal separation topology of the FIG. 7*c* example. It follows that a Minimize 724 (724-1 and 724-2) and a subtractor 726 (726-1 and 726-2) is associated with each LPC Synthesis Filter 720 and that each Minimize 724 also has the input signal (before separation) applied to it in order to minimize in a perceptually relevant way. Minimize 724-1 controls the Adaptive Codebook and Regular Codebook gains and the selection of the Regular Codebook excitation codevector, shown schematically at block 728-1. Minimize 724-2 controls the Structural Sinusoidal Codebook vector of gain values, shown schematically at block 728-2.

The output bitstream of the FIG. 7*c* example may include at least (1) a Control signal, (2) the gains $G_m$ $G_r$, and $G_s$ (3) the Regular Codebook and the Adaptive Codebook excitation codevector indices, (4) the LTP parameters from Pitch analysis 730, and (5) the LPC parameters from LPC analysis 738. The Control signal may contain the same information as in the examples of FIGS. 7*a* and 7*b*, although some of the information may be fixed (e.g., the position of the switch (736 in FIG. 7*b*). Typically, such information (the four categories listed just above) is formatted in a suitable way, multiplexed and entropy coded into a bitstream by a suitable device or function ("Multiplexer") 701. Any other suitable way of conveying such information to a decoder may be employed. The frequency of bitstream updating may be signal dependent. In practice it may be useful to update the bitstream components at the same rate as the signal segmentation.

In an alternative to the example of FIG. 7*c*, the LPC Synthesis Filter 720-2 may be omitted. As in the case of the alternatives to FIGS. 7*a* and 7*b*, this alternative requires the use of a modified decoder.

In the sub variation of FIG. 7*d*, another example of a unified speech-like signal/non-speech-like signal encoder according to aspects of the present invention is shown in which signal separation is employed. In the sub variation of FIG. 7*d*, the separation paths are interdependent (in the manner of FIG. 4*b*).

Referring to FIG. 7*d*, instead of a Signal Separation 762 separating the input signal into speech-like and non-speech-like signal components, a Signal Separation device or function 762' separates the speech-like signal components from the input signal. Each of the unseparated input and the separated speech-like signal components are segmented in their own Segmentation 712 devices or functions. The reconstructed speech-like signal (the output of LPC Synthesis Filter 720-1) is then subtracted from the segmented unseparated input signal in subtractor 727 to produce the separated non-speech-like signal to be coded. The separated non-speech-like signal to be coded then has the reconstructed non-speech-like signal from LPC Synthesis Filter 720-2 subtracted from it to provide a non-speech-like residual (error) signal for application to Minimize 724' device or function. In the manner of the FIG. 7*c* example, Minimize 724' also receives the speech-like signal residual (error) signal from subtractor 726-1. Minimize 724' also receives as a perceptual reference the segmented input signal so that it may operate in accordance with a psychoacoustic model. Minimize 724' operates to minimize the two respective error input signals by controlling its two outputs (one relating to the regular and adaptive codebooks and another relating to the sinusoidal codebook). Minimize 724' may also be implemented as two independent devices or functions in which one provides a control output for the regular and adaptive codebooks in response to the speech-like signal error and the perceptual reference and the other provides a control input for the sinusoidal codebook in response to the non-speech-like signal error and the perceptual reference.

In an alternative to the example of FIG. 7*d*, the LPC Synthesis Filter 720-2 may be omitted. As in the case of the alternatives to FIGS. 7*a*, 7*b*, and 7*c*, this alternative requires the use of a modified decoder.

The various relationships in the three examples may be better understood by reference to the following table:

| Characteristic | Example 1 FIG. 7a | Example 2 FIG. 7b | Example 3 FIGS. 7c, 7d |
|---|---|---|---|
| Signal Classification | None | Yes (with indication of high/low confidence) | Inherent part of Signal Separation |

-continued

| Characteristic | Example 1 FIG. 7a | Example 2 FIG. 7b | Example 3 FIGS. 7c, 7d |
|---|---|---|---|
| Selection of Codebook(s) | Closed Loop | Open Loop (if high confidence) Closed Loop (if low confidence | Open Loop (in effect) |
| Selection of Gain Vectors | Closed Loop | Closed Loop (whether or not high confidence) | Closed Loop |
| Use contribution of the structured sinusoidal codebook in LTP (the switch in FIGS. 7a, 7b) | Closed Loop | Open Loop (if high confidence) Closed Loop (if low confidence) (see the explanation below) | Not applicable |

The Regular Codebook

The purpose of the regular codebook is to generate the excitation for speech-like signal or speech-like signal-like audio signals, particularly the "unvoiced" speech-like noisy or irregular portion of the speech-like signal. Each entry of the regular codebook contains a codebook vector of length M, where M is the length of the analysis window. Thus, the contribution from the regular codebook $e_r[m]$ may be constructed as:

$$e_r[m] = \sum_{i=1}^{N} g_r[i]C_r[i, m], m = 1, \ldots , M.$$

Here $C_r[i,m]$, m=1, . . . , M is the $i^{th}$ entry of the codebook, $g_r[i]$ are the vector gains of the regular codebook, and N is the total number of the codebook entries. For economic reasons, it is common to allow the gain g, [i] to have non-zero values for a limited number (one or two) of selected entries so that it can be coded in a small amount of bits. The regular codebook can be populated by using a Gaussian random number generator (Gaussian codebook), or from vectors of multi-pulse at regular positions (Algebraic codebook). Detailed information regarding how to populate this kind of codebook can be found, for example, in reference 9 cited below.

The Structured Sinusoidal Codebook

The purpose of the Structured Sinusoidal Codebook is to generate speech-like signal and non-speech-like signal excitation signals appropriate for input signals having complex spectral characteristics, such as harmonic and multi-instrument non-speech-like signal signals, non-speech-like signal and vocals together, and multi-voice speech-like signal signals. When the order of the LPC Synthesis Filter 720 is set to zero and the Sinusoidal Codebook is used exclusively, the result is that the codec is capable of emulating a perceptual audio transform codec (including, for example, an AAC (Advanced Audio Coding) or an AC-3 encoder)."

The structured sinusoidal codebook constitutes entries of sinusoidal signals of various frequencies and phase. This codebook expands the capabilities of a conventional CELP encoder to include features from a transform-based perceptual audio encoder. This codebook generates the excitation signal that may be too complex to be generated effectively by the regular codebook, such as signals as just mentioned above. In a preferred embodiment the following sinusoidal codebook may be used where the codebook vectors may be given by:

$$C_s[i, m] = w[m]\cos\left(\frac{(i+0.5)(m+0.5+M)\pi}{2M}\right), m = 1, \ldots, 2M.$$

The codebook vectors represent the impulse responses of a Fast Fourier Transform (FFT), such as a Discrete Cosine Transform (DCT) or, preferably, a Modified Discrete Cosine Transform (MDCT) transform. Here w[m] is a window function. The contribution $e_s[m]$ from the sinusoidal codebook may be given by:

$$e_s[m] = \sum_{i=1}^{M} g_s[i]C_s[i, m], m = 1, \ldots, 2M.$$

Thus, the contribution from the sinusoidal codebook may be a linear combination of impulse responses in which the MDCT coefficients are the vector gains $g_s$. Here $C_s$[i,m], m=1, . . . , 2M is the $i^{th}$ entry of the codebook, $g_s$[i] are the vector gains of the sinusoidal codebook, and N is the total number of the codebook entries. Since the excitation signals generated from this codebook have a length double the analysis window, an overlap and add stage should be used so that the final excitation signal is constructed by adding the second half of the excitation signal of previous sample block to the first half of that of the current sample block.

The Adaptive Codebook

The purpose of the Adaptive Codebook is to generate the excitation for speech-like audio signals, particularly the "voiced" speech-like portion of the speech-like signal. In some cases the residual signal, e.g., voice segment of speech, exhibits strong harmonic structure where the residual waveform repeats itself after a period of time (pitch). This kind of excitation signal can be effectively generated with the help from the adaptive codebook. As shown in the examples of FIGS. 7*a* and 7*b*, the adaptive codebook has an LTP (long-term prediction) buffer where previously generated excitation signal may be stored, and an LTP extractor to extract, according to the pitch period detected from the signal, from the LTP buffer the past excitation that best represents the current excitation signal. Thus, the contribution $e_a$[m] from the adaptive codebook may be given by:

$$e_a[m] = \sum_{i=-L}^{L} g_a[i]r[m-i-D], m = 1, \ldots, M.$$

Here r[m−1−D], m=1, . . . , M is the $i^{th}$ entry of the codebook, $g_a$[i] are the vector gains of the regular codebook, and L is the total number of the codebook entries. In addition, D is the pitch period, and r[m] is the previously generated excitation signal stored in the LTP buffer. As can be seen in the examples of FIGS. 7 and 7*b*, the encoder has the additional flexibility to include or not to include the contribution from the sinusoidal codebook in the past excitation signal. In the former case r [m] may be given by:

$$r[m]=e_r[m]+e_s[m]+e_a[m],$$

and in the latter case it may be given by $$r[m]=e_r[m]+e_a[m]$$

Note that for a current sample block to be coded (m=1, . . . , M), the value of r [m] may be determined only for m≦0. If the pitch period D has a value smaller than the analysis window length M periodical extension of the LTP buffer may be needed:

$$r[m] = \begin{cases} r[m-D] & 0 \le m < D \\ r[m-2D] & D \le m < 2D \\ \vdots & \\ r[m-aD] & aD \le m < M. \end{cases}$$

Finally, the excitation signal e[n] to the LPC filter may be given the summation of the contributions of the above-described three codebooks:

$$e[m]=e_r[m]+e_s[m]+e_a[m].$$

The gain vectors $G_r$={$g_r$[1], $g_r$[2], . . . , $g_r$[N]}, $G_a$={$g_a$[−L], $g_a$[−L+1], . . . , $g_a$[L]} and Gs={$g_s$[1], $g_s$[2], . . . , $g_s$[M]} are chosen in such a way that the distortion between the original signal and the locally decoded signal, as measured by the psychoacoustic model in a perceptually meaningful way, is minimized. In principle, this can be done in a closed-loop manner where the optimal gain vectors can be decided by searching all the possible combination of the values of these gain vectors. However, in practice, such a closed-loop search method may be only feasible for the regular and adaptive codebooks, but not for the structured sinusoidal codebook since it has too many possible value combinations. In this case, it may also be possible to use a sequential search method where the regular codebook and the adaptive codebook are searched in a closed-loop manner first. The structured sinusoidal gain vector may be decided in an open-loop fashion, where the gain for each codebook entry may be decided by quantizing the correlation between the codebook entry and the residual signal after removing the contribution from the other two codebooks.

If desired an entropy encoder may be used in order to obtain a compact representation of the gain vectors before they are sent to the decoder. In addition, any gain vector for which all gains are zero may be efficiently coded with an escape code.

Unified Multimode Audio Decoder

Figure 8A:
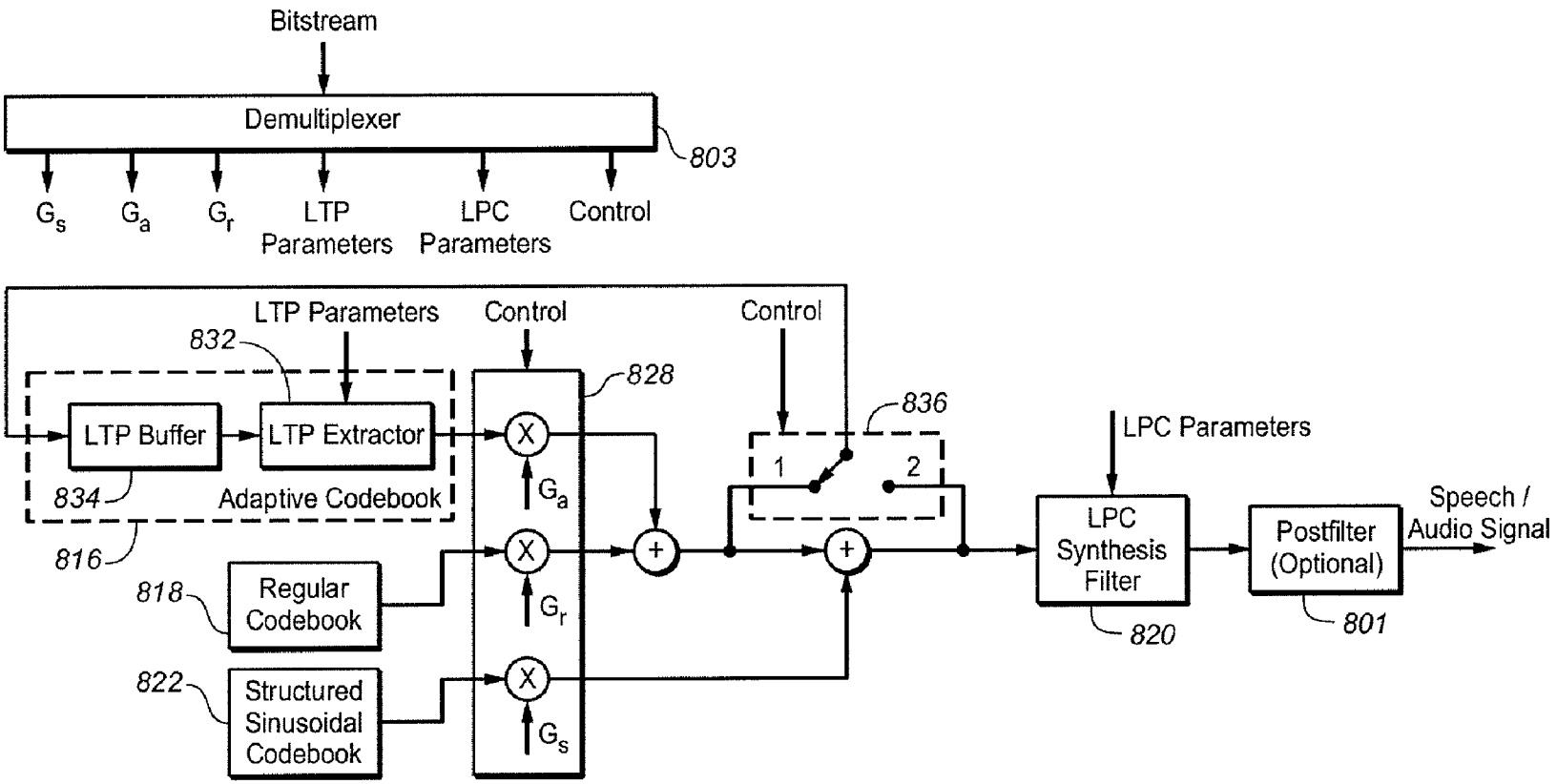
FIG. 8*a* is a schematic conceptual functional block diagram of a decoder usable with one version of any of the encoders of the examples of FIGS. 7*a*, 7*b*, 7*c*, and 7*d*. The decoder is essentially the same as the local decoder of the FIGS. 7*a* and 7*b* examples.

A decoder usable with any of the encoders of the examples of FIGS. 7*a*-7*d* is shown in FIG. 8*a*. The decoder is essentially the same as the local decoder of the FIGS. 7*a* and 7*b* examples and, thus, uses corresponding reference numerals for its elements (e.g., LTP Buffer 834 of FIG. 8*a* corresponds to LTP Buffer 734 of FIGS. 7*a* and 7*b*). An optional adaptive post-filter device or function ("Postfiltering") 801 similar to those in conventional CELP speech decoders may be added to process the output signal for speech-like signals. Referring to the details of FIG. 8*a*, a received bitstream is demultiplexed, deformatted, and decoded so as to provide at least the Control Signal, the vector gains $G_m$ $G_r$, and $G_s$, the LTP parameters, and the LPC parameters.

Figure 8B:
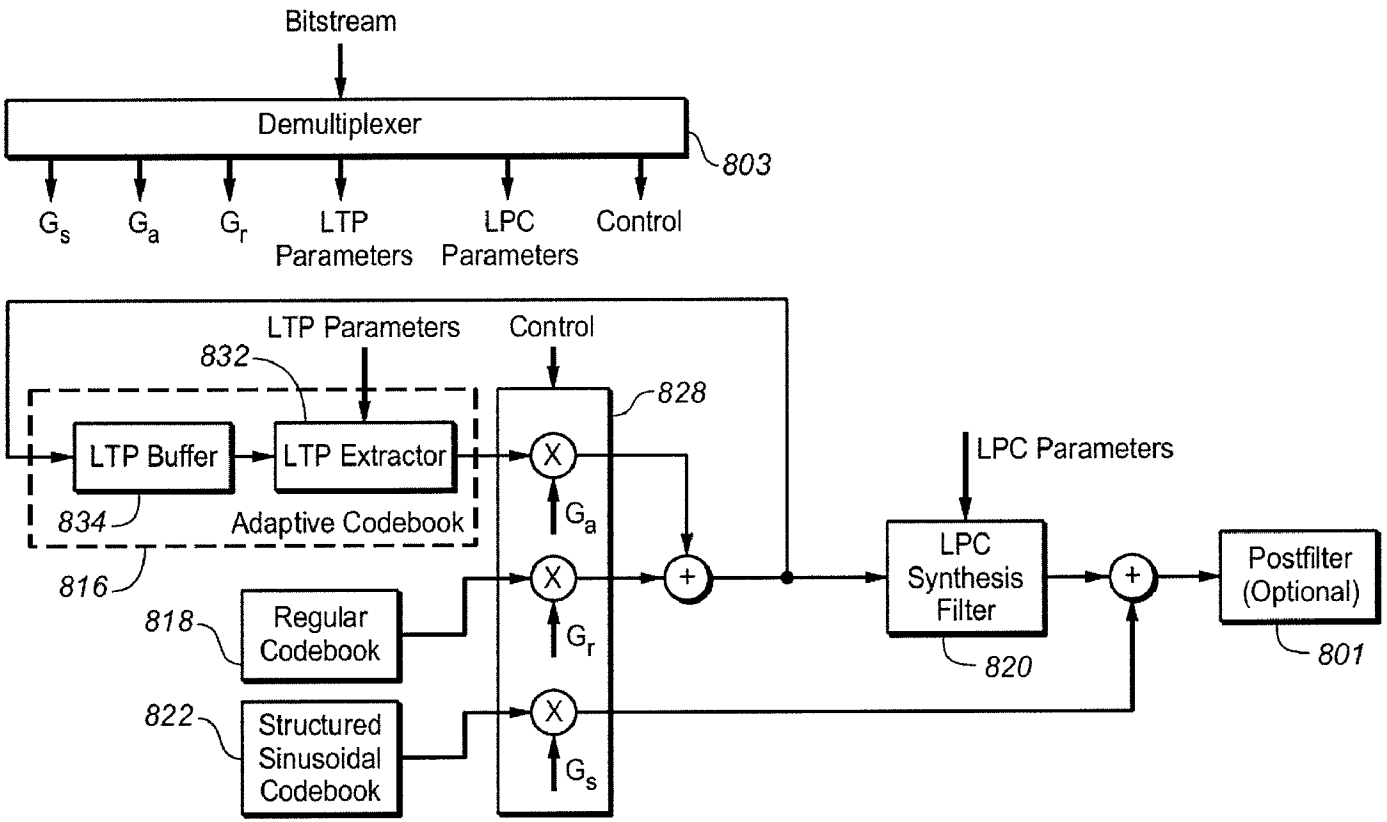
FIG. 8*b* is a schematic conceptual functional block diagram of a decoder usable with another version of any of the encoders of the examples of FIGS. 7*a*, 7*b*, 7*c*, and 7*d*.

As mentioned above, when the excitation produced by the Sinusoidal Codebook 722 is used to produce a residual error signal without LPC synthesis filtering (as in modifications of the encoding examples of FIGS. 7*a*-7*d*), a modified decoder should be employed. An example of such a decoder is shown in FIG. 8*b*. It differs from the example of FIG. 8*a* in that the Sinusoidal Codebook 822 excitation output is combined with the LPC filtered adaptive and regular codebook outputs after they are filtered.

Implementation

The invention may be implemented in hardware or software, or a combination of both (e.g., programmable logic arrays). Unless otherwise specified, algorithms and processes included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be considered to be implemented as a computer-readable storage medium, configured with a computer program, where the storage medium so configured causes a computer system to operate in a specific and predefined manner to perform the functions described herein. A number of embodiments of the invention have been described. Nevertheless, it will be understood that various modifications may be made without departing from the spirit and scope of the invention. For example, some of the steps described herein may be order independent, and thus can be performed in an order different from that described.

INCORPORATION BY REFERENCE

The following publications are hereby incorporated by reference, each in their entirety.

[1] J.-H. Chen and D. Wang, "Transform Predictive Coding of Wideband Speech Signals," Proc. ICASSP-96, vol. 1, May 1996.

[2] S. Wang, "Phonetic Segmentation Techniques for Speech Coding," Ph.D. Thesis, University of California, Santa Barbara, 1991.

[3] A. Das, E. Paksoy, A. Gersho, "Multimode and Variable-Rate Coding of Speech," in Speech Coding and Synthesis, W. B. Kleijn and K. K. Paliwal Eds., Elsevier Science B.V., 1995.

[4] B. Bessette, R. Lefebvre, R. Salami, "Universal Speech/Audio Coding using Hybrid ACELP/TCX Techniques," Proc. ICASSP-2005, March 2005.

[5] S. Ramprashad, "A Multimode Transform Predictive Coder (MTPC) for Speech and Audio," IEEE Speech Coding Workshop, Helsinki, Finland, June 1999.

[6] S. Ramprashad, "The Multimode Transform Predictive Coding Paradigm," IEEE Trans. On Speech and Audio Processing, March 2003.

[7] Shoji Makino (Editor), Te-Won Lee (Editor), Hiroshi Sawada (Editor), Blind Speech Separation (Signals and Communication Technology), Springer, 2007.

[8] M. Yong, G. Davidson, and A. Gersho, "Encoding of LPC Spectral Parameters Using Switched-Adaptive Interframe Vector Prediction," IEEE Intl. Conf. on Acoustics, Speech, and Signal Processing, 1988.

[9] A. M. Kondoz, Digital speech coding for low bit rate communication system, $2^{nd}$ edition, section 7.3.4, Wiley, 2004.

The following United States patents are hereby incorporated by reference, each in its entirety:

U.S. Pat. No. 5,778,335 Ubale et al;
U.S. Pat. No. 7,146,311 B1 Uvliden et al;
U.S. Pat. No. 7,203,638 B2 Lelinek et al;
U.S. Pat. No. 7,194,408 B2 Uvliden et al;
U.S. Pat. No. 6,658,383 B2 Koishida et al; and
U.S. Pat. No. 6,785,645 B2 Khalil et al.

We claim:

1. A method for code excited linear prediction (CELP) audio encoding employing an LPC synthesis filter controlled by LPC parameters, a plurality of codebooks each having codevectors, at least one codebook providing an excitation more appropriate for speech-like signals than for non-speech-like signals and at least one other codebook providing an excitation more appropriate for non-speech-like signals than for speech like signals, and a plurality of gain factors, each associated with a codebook, wherein a speech-like signal means a signal that comprises either a) a single, strong periodical component (a "voiced" speech-like signal), b) random noise with no periodicity (an "unvoiced" speech-like signal), or c) the transition between such signal types, and a non-speech-like signal means a signal that does not have the characteristics of a speech-like signal, the method comprising applying linear predictive coding (LPC) analysis to an audio signal to produce LPC parameters, selecting, from at least two codebooks, codevectors and/or associated gain factors by minimizing a measure of the difference between said audio signal and a reconstruction of said audio signal derived from the codebook excitations, said at least two codebooks including said at least one codebook providing an excitation more appropriate for speech like signals and said at least one other codebook providing an excitation more appropriate for non-speech-like signals, and generating an output usable by a CELP audio decoder to reconstruct the audio signal, said output including LPC parameters, codevector indices, and gain factors, wherein the at least one codebook providing an excitation output more appropriate for speech-like signals than for non-speech-like signals includes a codebook that produces a noise-like excitation and a codebook that produces a periodic excitation and said at least one other codebook includes a codebook that produces a sinusoidal excitation useful for emulating a perceptual audio encoder.

2. A method according to claim 1 wherein some of the signals derived from the codebook excitation outputs are filtered by said linear predictive coding synthesis filter.

3. A method according to claim 2 wherein the signal or signals derived from codebooks whose excitation outputs are more appropriate for speech-like signals than for non-speech-like signals are filtered by said linear predictive coding synthesis filter.

4. A method according to claim 3 wherein the signal or signals derived from codebooks whose excitation outputs are more appropriate for non-speech-like signals than for speech-like signals are not filtered by said linear predictive coding synthesis filter.

5. A method according to claim 4 further comprising applying a long-term prediction (LTP) analysis to said audio signal to produce LTP parameters, wherein said codebook that produces a periodic excitation is an adaptive codebook controlled by said LTP parameters and receiving as a signal input a time-delayed combination of at least the periodic and the noise-like excitation, and wherein said output further includes said LTP parameters.

6. A method according to claim 5 wherein said adaptive codebook receives, selectively, as a signal input, either a time-delayed combination of the periodic excitation, the noise-like excitation, and the sinusoidal excitation or only a time-delayed combination of the periodic excitation and the noise-like excitation, and wherein said output further includes information as to whether the adaptive codebook receives the sinusoidal excitation in the combination of excitations.

7. A method according to claim 1 further comprising classifying the audio signal into one of a plurality of signal classes, selecting a mode of operation in response to said classifying, and selecting, in an open-loop manner, one or more codebooks exclusively to contribute excitation outputs.

8. A method according to claim 7 further comprising determining a confidence level to said selecting a mode of operation, wherein there are at least two confidence levels including a high confidence level, and selecting, in an open-loop manner, one or more codebooks exclusively to contribute excitation outputs only when the confidence level is high.

9. A method according to claim 1 wherein said minimizing minimizes the difference between the reconstruction of the audio signal and the audio signal in a closed-loop manner.

10. A method according to claim 1 wherein said measure of the difference is a perceptually-weighted measure.

11. A method for code excited linear prediction (CELP) audio encoding employing an LPC synthesis filter controlled by LPC parameters, a plurality of codebooks each having codevectors, at least one codebook providing an excitation more appropriate for speech-like signals than for non-speech-like signals and at least one other codebook providing an excitation more appropriate for non-speech-like signals than for speech like signals, and a plurality of gain factors, each associated with a codebook, wherein a speech-like signal means a signal that comprises either a) a single, strong periodical component (a "voiced" speech-like signal), b) random noise with no periodicity (an "unvoiced" speech-like signal), or c) the transition between such signal types, and a non-speech-like signal means a signal that does not have the characteristics of a speech-like signal, the method comprising separating an audio signal into speech-like and non-speech-like signal components, applying linear predictive coding (LPC) analysis to the speech-like signal components of the audio signal to produce LPC parameters, minimizing the difference between the LPC synthesis filter output and the speech-like signal components of the audio signal by varying codevector selections and/or gain factors associated with the or each codebook providing an excitation output more appropriate for speech-like signals than for non-speech-like signals, varying codevector selections and/or gain factors associated with the or each codebook providing an excitation output more appropriate for non-speech-like signals than for speech-like signals, and providing an output usable by a CELP audio decoder to reproduce an approximation of the audio signal, the output including codevector indices and/or gains associated with each codebook, and said LPC parameters, wherein the at least one codebook providing an excitation output more appropriate for speech-like signals than for non-speech-like signals includes a codebook that produces a noise-like excitation and a codebook that produces a periodic excitation and the at least one other codebook providing an excitation output more appropriate for non-speech-like signals than for speech-like signals includes a codebook that produces a sinusoidal excitation useful for emulating a perceptual audio encoder.

12. The method of claim 11 wherein said separating separates the audio signal into a speech-like signal component and a non-speech-like signal component.

13. The method of claim 11 wherein said separating separates the speech-like signal components from the audio signal and derives an approximation of the non-speech-like signal components by subtracting a reconstruction of the speech-like signal components from the audio signal.

14. The method of claim 11 wherein said separating separates the non-speech-like signal components from the audio signal and derives an approximation of the speech-like signal components by subtracting a reconstruction of the non-speech-like signal components from the audio signal.

15. The method of any one of claim 11 through 14 further comprising providing a second linear predictive coding (LPC) synthesis filter and wherein the reconstruction of the non-speech-like signal components is filtered by said second linear predictive coding synthesis filter.

16. A method according to claim 11 further comprising applying a long-term prediction (LTP) analysis to the speech-like signal components of said audio signal to produce LTP parameters, wherein said codebook that produces a periodic excitation is an adaptive codebook controlled by said LTP parameters and receiving as a signal input a time-delayed combination of the periodic excitation and the noise-like excitation.

17. A method according to claim 11 wherein codebook vector selections and/or gain factors associated with the or each codebook providing an excitation output more appropriate for non-speech-like signals than for speech-like signals are varied in response to the speech-like signal components.

18. A method according to claim 11 wherein codebook vector selections and/or gain factors associated with the or each codebook providing an excitation output more appropriate for non-speech-like signals than for speech-like signals are varied to reduce the difference between the non-speech-like signal components and a signal reconstructed from the or each such codebook.

19. A method for code excited linear prediction (CELP) audio decoding employing an LPC synthesis filter controlled by LPC parameters, a plurality of codebooks each having codevectors, at least one codebook providing an excitation more appropriate for speech-like signals than for non-speech-like signals and at least one other codebook providing an excitation more appropriate for non-speech-like signals than for speech like signals, and a plurality of gain factors, each associated with a codebook, wherein a speech-like signal means a signal that comprises either a) a single, strong periodical component (a "voiced" speech-like signal), b) random noise with no periodicity (an "unvoiced" speech-like signal), or c) the transition between such signal types, and a non-speech-like signal means a signal that does not have the characteristics of a speech-like signal, the method comprising receiving said parameters, codevector indices, and gain factors, deriving an excitation signal for said LPC synthesis filter from at least one codebook excitation output, and deriving an audio output signal from the output of said LPC filter or from the combination of the output of said LPC synthesis filter and the excitation of one or more ones of said codebooks, the combination being controlled by codevectors and/or gain factors associated with each of the codebooks, wherein the at least one codebook providing an excitation output more appropriate for speech-like signals than for non-speech-like signals includes a codebook that produces a noise-like excitation and a codebook that produces a periodic excitation and the at least one other codebook includes a codebook that produces a sinusoidal excitation useful for emulating a perceptual audio encoder.

20. A method according to claim 19 wherein said codebook that produces periodic excitation is an adaptive codebook controlled by said LTP parameters and receiving as a signal input a time-delayed combination of at least the periodic and noise-like excitation, and the method further comprises receiving LTP parameters.

21. A method according to claim 20 wherein the excitation of all of the codebooks is applied to the LPC filter and said adaptive codebook receives, selectively, as a signal input, either a time-delayed combination of the periodic excitation, the noise-like excitation, and the sinusoidal excitation or only a time-delayed combination of the periodic and the noise-like excitation, and wherein said method further comprises receiving information as to whether the adaptive codebook receives the sinusoidal excitation in the combination of excitations.

22. A method according to any one of claim 19, 20 or 21 wherein said deriving an audio output signal from the output of said LPC filter includes postfiltering.

23. A computer program, stored on a non-transitory computer-readable medium for causing a computer to perform the methods of any one of claim 1, 11, or 19.

24. Apparatus for code excited linear prediction (CELP) audio encoding employing an LPC synthesis filter controlled by LPC parameters, a plurality of codebooks each having codevectors, at least one codebook providing an excitation more appropriate for speech-like signals than for non-speech-like signals and at least one other codebook providing an excitation more appropriate for non-speech-like signals than for speech like signals, and a plurality of gain factors, each associated with a codebook, wherein a speech-like signal means a signal that comprises either a) a single, strong periodical component (a "voiced" speech-like signal), b) random noise with no periodicity (an "unvoiced" speech-like signal), or c) the transition between such signal types, and a non-speech-like signal means a signal that does not have the characteristics of a speech-like signal, the apparatus comprising means for applying linear predictive coding (LPC) analysis to an audio signal to produce LPC parameters, means for selecting, from at least two codebooks, codevectors and/or associated gain factors by minimizing a measure of the difference between said audio signal and a reconstruction of said audio signal derived from the codebook excitations, said at least two codebooks including said at least one codebook providing an excitation more appropriate for speech like signals and said at least one other codebook providing an excitation more appropriate for non-speech-like signals, and means for generating an output usable by a CELP audio decoder to reconstruct the audio signal, said output including LPC parameters, codevector indices, and gain factors, wherein the at least one codebook providing an excitation output more appropriate for speech-like signals than for non-speech-like signals includes a codebook that produces a noise-like excitation and a codebook that produces a periodic excitation and said at least one other codebook includes a codebook that produces a sinusoidal excitation useful for emulating a perceptual audio encoder.

25. Apparatus for code excited linear prediction (CELP) audio encoding employing an LPC synthesis filter controlled by LPC parameters, a plurality of codebooks each having codevectors, at least one codebook providing an excitation more appropriate for speech-like signals than for non-speech-like signals and at least one other codebook providing an excitation more appropriate for non-speech-like signals than for speech like signals, and a plurality of gain factors, each associated with a codebook, wherein a speech-like signal means a signal that comprises either a) a single, strong periodical component (a "voiced" speech-like signal), b) random noise with no periodicity (an "unvoiced" speech-like signal), or c) the transition between such signal types, and a non-speech-like signal means a signal that does not have the characteristics of a speech-like signal, the apparatus comprising means for separating an audio signal into speech-like and non-speech-like signal components, means for applying linear predictive coding (LPC) analysis to the speech-like signal components of the audio signal to produce LPC parameters, means for minimizing the difference between the LPC synthesis filter output and the speech-like signal components of the audio signal by varying codevector selections and/or gain factors associated with the or each codebook providing an excitation output more appropriate for speech-like signals than for non-speech-like signals, varying codevector selections and/or gain factors associated with the or each codebook providing an excitation output more appropriate for non-speech-like signals than for speech-like signals, and means for providing an output usable by a CELP audio decoder to reproduce an approximation of the audio signal, the output including codevector indices and/or gains associated with each codebook, and said LPC parameters, wherein the at least one codebook providing an excitation output more appropriate for speech-like signals than for non-speech-like signals includes a codebook that produces a noise-like excitation and a codebook that produces a periodic excitation and the at least one other codebook providing an excitation output more appropriate for non-speech-like signals than for speech-like signals includes a codebook that produces a sinusoidal excitation useful for emulating a perceptual audio encoder.

26. Apparatus for code excited linear prediction (CELP) audio decoding employing an LPC synthesis filter controlled by LPC parameters, a plurality of codebooks each having codevectors, at least one codebook providing an excitation more appropriate for speech-like signals than for non-speech-like signals and at least one other codebook providing an excitation more appropriate for non-speech-like signals than for speech like signals, and a plurality of gain factors, each associated with a codebook, wherein a speech-like signal means a signal that comprises either a) a single, strong periodical component (a "voiced" speech-like signal), b) random noise with no periodicity (an "unvoiced" speech-like signal), or c) the transition between such signal types, and a non-speech-like signal means a signal that does not have the characteristics of a speech-like signal, the apparatus comprising means for receiving said parameters, codevector indices, and gain factors, means for deriving an excitation signal for said LPC synthesis filter from at least one codebook excitation output, and means for deriving an audio output signal from the output of said LPC filter or from the combination of the output of said LPC synthesis filter and the excitation of one or more ones of said codebooks, the combination being controlled by codevectors and/or gain factors associated with each of the codebooks, wherein the at least one codebook providing an excitation output more appropriate for speech-like signals than for non-speech-like signals includes a codebook that produces a noise-like excitation and a codebook that produces a periodic excitation and the at least one other codebook includes a codebook that produces a sinusoidal excitation useful for emulating a perceptual audio encoder.

* * * * *